US009466952B2

(12) United States Patent
Kameda

(10) Patent No.: US 9,466,952 B2
(45) Date of Patent: Oct. 11, 2016

(54) SPARK PLUG

(71) Applicant: NGK SPARK PLUG CO., LTD., Nagoya-shi, Aichi (JP)

(72) Inventor: Hiroyuki Kameda, Nagakute (JP)

(73) Assignee: NGK SPARK PLUG CO., LTD., Aichi (JP)

( * ) Notice: Subject to any disclaimer, the term of this patent is extended or adjusted under 35 U.S.C. 154(b) by 0 days.

(21) Appl. No.: 14/719,828

(22) Filed: May 22, 2015

(65) Prior Publication Data

US 2015/0340845 A1 Nov. 26, 2015

(30) Foreign Application Priority Data

May 23, 2014 (JP) ..... 2014-107101

(51) Int. Cl.
*H01T 13/46* (2006.01)
*H01T 13/32* (2006.01)

(52) U.S. Cl.
CPC ..... *H01T 13/462* (2013.01); *H01T 13/467* (2013.01); *H01T 13/32* (2013.01)

(58) Field of Classification Search
CPC .... H01T 13/32; H01T 13/462; H01T 13/467
USPC ..... 313/118, 141, 143
See application file for complete search history.

(56) References Cited

U.S. PATENT DOCUMENTS 5,502,351 A 3/1996 Katoh et al. ..... 313/141
5,680,002 A * 10/1997 Kunitomo ..... H01T 13/467 313/141
6,472,801 B1 * 10/2002 Matsubara ..... H01T 13/52 313/141
6,853,116 B2 2/2005 Hori et al. ..... 313/141
9,027,524 B2 5/2015 Musasa et al. ..... 123/169 EL
2002/0033659 A1 3/2002 Nishikawa et al. ..... 313/118
2002/0105254 A1 8/2002 Hori et al. ..... 313/141
2006/0055299 A1 * 3/2006 Koyama ..... H01T 13/32 313/143
2008/0164800 A1 * 7/2008 Watanabe ..... H01T 13/467 313/141
2008/0284304 A1 * 11/2008 Watanabe ..... H01T 13/32 313/141

(Continued)

FOREIGN PATENT DOCUMENTS

AT 395788 B 3/1993 ..... H01T 13/32
CN 1137697 A 12/1996 ..... H01T 13/32

(Continued)

OTHER PUBLICATIONS

Search Report issued in corresponding European Patent Application No. 15168918.9, dated Oct. 8, 2015.

(Continued)

*Primary Examiner* — Donald Raleigh
*Assistant Examiner* — Kevin Quarterman
(74) *Attorney, Agent, or Firm* — Kusner & Jaffe

(57) ABSTRACT

A spark plug having an insulator, a metallic shell disposed around the insulator, a first ground electrode having a first surface facing a side surface of a center electrode in a radial direction so as to form a first gap, and a second ground electrode having a second surface facing the side surface of the center electrode in the radial direction so as to form a second gap. A relation 60°≤θ≤150° is satisfied, where θ is a smaller one of angles formed between a first line connecting an axial line of the center electrode and the center of the first surface and a second line connecting the axis and a center of the second surface when viewed from a forward end side toward a rear end side in the direction of the axis.

11 Claims, 9 Drawing Sheets

(56) References Cited

U.S. PATENT DOCUMENTS

| | | | | |
|---|---|---|---|---|
| 2010/0275869 | A1* | 11/2010 | Musasa | C22C 1/0466 123/169 EL |
| 2010/0320894 | A1 | 12/2010 | Hartmann et al. | 313/142 |
| 2011/0215702 | A1* | 9/2011 | Kameda | H01T 13/32 313/141 |
| 2013/0328476 | A1* | 12/2013 | Ban | H01T 13/32 313/141 |

FOREIGN PATENT DOCUMENTS

| | | | | |
|---|---|---|---|---|
| CN | 101904066 | A | 12/2010 | C22C 5/04 |
| EP | 1063745 | A1 | 12/2000 | H01T 13/52 |
| EP | 2360797 | A1 | 8/2011 | H01T 13/32 |
| JP | S59-29358 | Y2 | 8/1984 | H01T 13/32 |
| JP | S61-51483 | U | 4/1986 | F02P 15/10 |
| JP | H05-33754 | A | 2/1993 | F02B 77/08 |
| JP | 2002-237365 | A | 8/2002 | H01T 13/20 |
| JP | 2008-258077 | A | 10/2008 | F02P 13/00 |

OTHER PUBLICATIONS

Office Action received in corresponding Japanese Patent Application No. 2014-107101, dated Mar. 1, 2016 (English translation provided).

Office Action received in corresponding Chinese Patent Application No. 201510266521, dated Jun. 2, 2016.

* cited by examiner

SAMPLE S1 FOR LATERAL DISCHARGE

SAMPLE S2 FOR LONGITUDINAL DISCHARGE

SAMPLE S3 FOR LATERAL AND LONGITUDINAL DISCHARGE

SPARK PLUG

RELATED APPLICATIONS

This application claims priority from Japanese Patent Application No. 2014-107101, filed with the Japanese Patent Office on May 23, 2014, the entire content of which is hereby incorporated by reference.

FIELD OF THE INVENTION

The present invention relates to a spark plug used for ignition in an internal combustion engine or the like.

BACKGROUND OF THE INVENTION

A spark plug generates a spark at a gap formed between a distal end portion of a center electrode and a distal end portion of a ground electrode upon application of a voltage between the center electrode and the ground electrode, which are insulated from each other by means of an insulator. For example, Japanese Patent Application Laid-Open (kokai) No. 2002-237365 discloses a spark plug in which the center electrode and the ground electrode face each other in the axial direction so as to form a gap.

Incidentally, in order to decrease the fuel cost of an internal combustion engine and/or purify exhaust gas, the degree of leanness of air-fuel mixture and/or the amount of re-circulated gas (EGR gas) has been increased. In order to compensate for a decrease in flame propagation speed caused by the increased degree of leanness of air-fuel mixture and/or the increased amount of re-circulated gas, the speed of a gas flow within a combustion chamber of the internal combustion engine tends to be increased. As a result, in the spark plug of Patent Document 1, a phenomenon in which the spark generated at the gap of the spark plug is blown by the gas flow and is quenched (spark blowout) becomes likely to occur. The spark blowout prevents extension of a spark discharge path to thereby deteriorate the ignition performance of the spark plug, and causes multiple discharge to thereby deteriorate the durability of the spark plug. Therefore, there has been a demand for a technique of securing the required ignition performance and durability of the spark plug even when the speed of a gas flow within a combustion chamber is high.

An object of the present invention is to secure the required ignition performance and durability of a spark plug even when the speed of a gas flow within a combustion chamber is high.

SUMMARY OF THE INVENTION

The present invention has been accomplished so as to solve, at least partially, the above-described problem, and the present invention can be embodied in the following application examples.

Application Example 1

In accordance with a first aspect of the present invention, there is provided a spark plug comprising:

a center electrode extending in a direction of an axial line;

an insulator having an axial hole which extends in the direction of the axial line and in which the center electrode is disposed; and a metallic shell disposed around the insulator, wherein the metallic shell has a first ground electrode which is electrically connected to the metallic shell and has a first surface facing a side surface of the center electrode in a radial direction so as to form a first gap, and a second ground electrode which is electrically connected to the metallic shell and has a second surface facing the side surface of the center electrode in the radial direction so as to form a second gap;

a relation $60° \leq \theta \leq 150°$ is satisfied, where $\theta$ is a smaller one of angles formed between a first line connecting the axis and a center of the first surface and a second line connecting the axial line and a center of the second surface when viewed from a forward end side toward a rear end side in the direction of the axis; and the metallic shell has a specific plane which bisects the metallic shell such that all the ground electrodes are located on one side of the plane.

According to the above-described configuration, through proper determination of the layout of the two ground electrodes, spark blowout can be suppressed, and extension of the spark discharge path can be promoted. As a result, even in the case where the speed of a gas flow within a combustion chamber is high, the required ignition performance and durability of the spark plug can be secured.

Application Example 2

In accordance with a second aspect of the present invention, there is provided a spark plug as described in the application example 1, wherein at a position in the direction of the axis at which the first surface and the second surface face each other, the center electrode has an outer diameter greater than largest widths of the first surface and the second surface.

According to the above-described configuration, the outer diameter of the center electrode is rendered larger than the largest widths of the first and second surfaces of the ground electrodes which form the respective gaps. Therefore, spark blowout can be suppressed to a greater degree. As a result, the durability of the spark plug can be enhanced further.

Application Example 3

In accordance with a third aspect of the present invention, there is provided a spark plug as described in the application example 1 or 2, wherein the first ground electrode has a first ground electrode tip including the first surface, and a first ground electrode main body to which the first ground electrode tip is joined;

the second ground electrode has a second ground electrode tip including the second surface, and a second ground electrode main body to which the second ground electrode tip is joined; and largest widths of the first ground electrode main body and the second ground electrode main body are greater than the outer diameter of the center electrode.

According to the above-described configuration, the largest widths of the first and second ground electrode main bodies are rendered larger than the outer diameter of the center electrode. Therefore, flows of air-fuel mixture (gas flows) detouring around the two ground electrode main bodies (in particular, detouring around the two ground electrode main bodies to pass through the downstream sides thereof) are restrained from reaching the vicinity of the gaps. As a result, a drop in the flow speed of fuel gas in the vicinity of the gaps can be suppressed, whereby the ignition performance of the spark plug can be enhanced.

Application Example 4

In accordance with a fourth aspect of the present invention, there is provided a spark plug as described in any one of the application examples 1 through 3, wherein the first ground electrode has a first ground electrode tip including the first surface, and a first ground electrode main body to which the first ground electrode tip is joined;

the second ground electrode has a second ground electrode tip including the second surface, and a second ground electrode main body to which the second ground electrode tip is joined; and a projection length by which the first ground electrode tip projects from the first ground electrode main body inward in the radial direction of the metallic shell and a projection length by which the second ground electrode tip projects from the second ground electrode main body inward in the radial direction of the metallic shell are equal to or greater than 0.5 mm.

According to the above-described configuration, the projection lengths by which the ground electrode tips project radially inward from the corresponding ground electrode main bodies are rendered relatively large. Therefore, flows of air-fuel mixture detouring around the two ground electrode main bodies are restrained from reaching the vicinity of the gaps. As a result, a drop in the flow speed of fuel gas in the vicinity of the gaps can be suppressed, whereby the ignition performance of the spark plug can be enhanced.

Application Example 5

In accordance with a fifth aspect of the present invention, there is provided a spark plug as described in any one of the application examples 1 through 4, wherein the spark plug is driven by a current supply section which can supply a current of 25 mA or more to the spark plug over a period of 0.5 ms or longer for discharge of one time.

According to the above-described configuration, spark blowout is less likely to occur when a current supply section which can supply current for a relatively long time is used. Accordingly, it is possible to realize an ignition performance corresponding to the current supply capacity of the current supply section.

Application Example 6

In accordance with a sixth aspect of the present invention, there is provided a spark plug as described in any one of the application examples 1 through 5, wherein the spark plug is attached to an internal combustion engine in such a manner that when viewed from the forward end side toward the rear end side in the direction of the axial line, an upstream portion of a flow path of an air-fuel mixture passing through the first gap and the second gap within a combustion chamber of the internal combustion engine is located within a range of the angle θ.

According to the above-described configuration, spark blowout caused by the flow of air-fuel mixture (gas flow) can be prevented effectively, whereby the durability and ignition performance of the spark plug can be enhanced.

Notably, the present invention can be realized in various forms. For example, the present invention can be realized as a spark plug, an ignition apparatus using the spark plug, a method of attaching the spark plug, an internal combustion engine having the spark plug mounted thereon, or an internal combustion engine having an ignition apparatus mounted thereon and using the spark plug.

DETAILED DESCRIPTION OF THE PREFERRED EMBODIMENTS

A. First Embodiment

Figure 1:
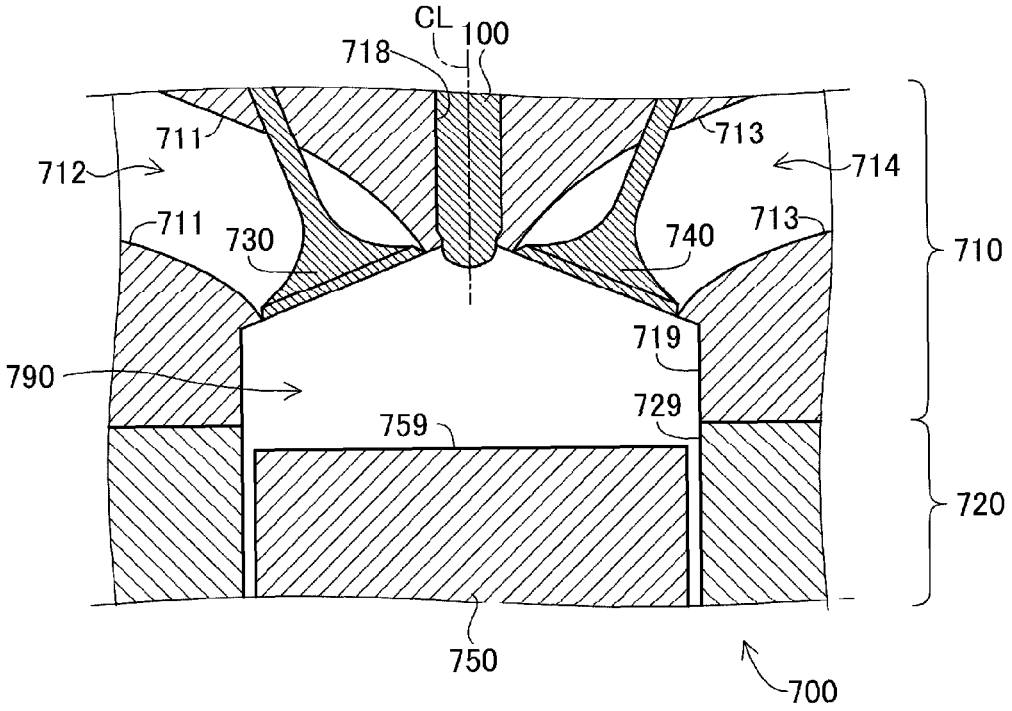
FIG. 1 is a view showing an example of an internal combustion engine to which a spark plug 100 of the present embodiment is attached.

FIG. 1 is a view showing an example of an internal combustion engine to which a spark plug 100 of the present embodiment is attached. FIG. 1 shows a schematic sectional view of one combustion chamber 790 of a plurality of (for example, four) combustion chambers (also called cylinders) of an internal combustion engine 700. The internal combustion engine 700 includes an engine head 710, a cylinder block 720, a piston 750, and the spark plug 100. The piston 750 is connected to an unillustrated connecting rod, and the connecting rod is connected to an unillustrated crankshaft.

The cylinder block 720 has a cylinder wall 729 which forms a portion (generally cylindrical space) of the combustion chamber 790. The engine head 710 is fixed to one side (upper side of FIG. 1) of the cylinder block 720. The engine head 710 has an inner wall 719 which forms an end portion of the combustion chamber 790, a first wall 711 which forms an intake port 712 communicating with the combustion chamber 790, intake valves 730 which can open and close the intake port 712, a second wall 713 which forms an exhaust port 714 communicating with the combustion chamber 790, and exhaust valves 740 which can open and close the exhaust port 714, and an attachment hole 718 to which the spark plug 100 is attached. The piston 750 reciprocates within a space formed by the cylinder wall 729. A space surrounded by a surface 759 of the piston 750 on the side closer to the engine head 710, the cylinder wall 729 of the cylinder block 720, and the inner wall 719 of the engine head 710 corresponds to the combustion chamber 790. The spark plug 100 has a center electrode 20 and a ground electrode 30 exposed to the combustion chamber 790. A center axis CL shown in FIG. 1 is the center axis CL of the center electrode 20 (also referred to as the axial line CL).

Figure 2:
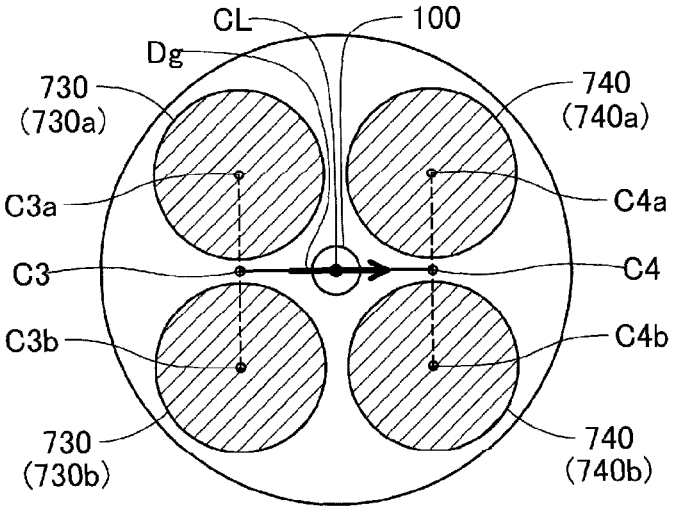
FIG. 2 is a projection view showing an example of the layout of the spark plug 100, intake valves 730, and exhaust valves 740.

FIG. 2 is a projection view showing an example of the layout of the spark plug 100, the intake valves 730, and exhaust valves 740. This projection view is obtained by projecting the elements 100, 730, and 740 on a projection plane orthogonal to the axial line CL of the center electrode 20 of the spark plug 100. The elements 100, 730, and 740 shown in FIG. 2 are the elements for one combustion chamber 790 (FIG. 1). In FIG. 2, regions representing the valves 730 and 740 are hatched.

As shown in FIG. 2, one spark plug 100, two intake valves 730, and two exhaust valves 740 are provided for one combustion chamber 790 of the internal combustion engine 700 of the present embodiment. The valves 730 and 740 in the projection view show the valves 730 and 740 in the closed state. The valves 730 and 740 in the projection view show respective portions of the valves 730 and 740 which can be seen from the interior of the combustion chamber 790. In the following description, when the two intake valves 730 are to be distinguished from each other, an identifier (here, "a" or "b") is added to the end of the symbol "730." This also applies to the two exhaust valves 740.

FIG. 2 shows the center positions C3*a*, C3*b*, C4*a*, and C4*b* of the valves 730*a*, 730*b*, 740*a*, and 740*b*. These center positions C3*a*, C3*b*, C4*a*, and C4*b* respectively show the positions of the centroids of the regions representing the valves 730*a*, 730*b*, 740*a*, and 740*b* on the projection plane shown in FIG. 2. For example, the first center position C3*a* is the position of the centroid of the region representing the first intake valve 730*a*. Notably, the centroid of each region is the position of the centroid determined under the assumption that the mass distributes uniformly within the region.

FIG. 2 shows two centroid positions C3 and C4. The intake centroid position C3 is the centroid position of the center positions C3*a* and C3*b* of the two intake valves 730*a* and 730*b*. The exhaust centroid position C4 is the centroid position of the center positions C4*a* and C4*b* of the two exhaust valves 740*a* and 740*b*. Notably, the centroid position of a plurality of center positions is the position of the centroid determined under the assumption that the same mass is disposed at each center position.

A flow direction Dg indicated by an arrow in FIG. 2 is a direction which is approximately perpendicular to the axial line CL and directed from the intake centroid position C3 toward the exhaust centroid position C4 (also referred to as the "valve disposition direction"). At the time of ignition by the spark plug 100, fuel gas (mixture of air and fuel) flows in the flow direction Dg in a region in the vicinity of the forward end of the spark plug 100 within the combustion chamber 790. The arrow of FIG. 2 showing the flow direction Dg can be said to show the flow path of the air-fuel mixture in the vicinity of the forward end of the spark plug 100.

Figure 3:
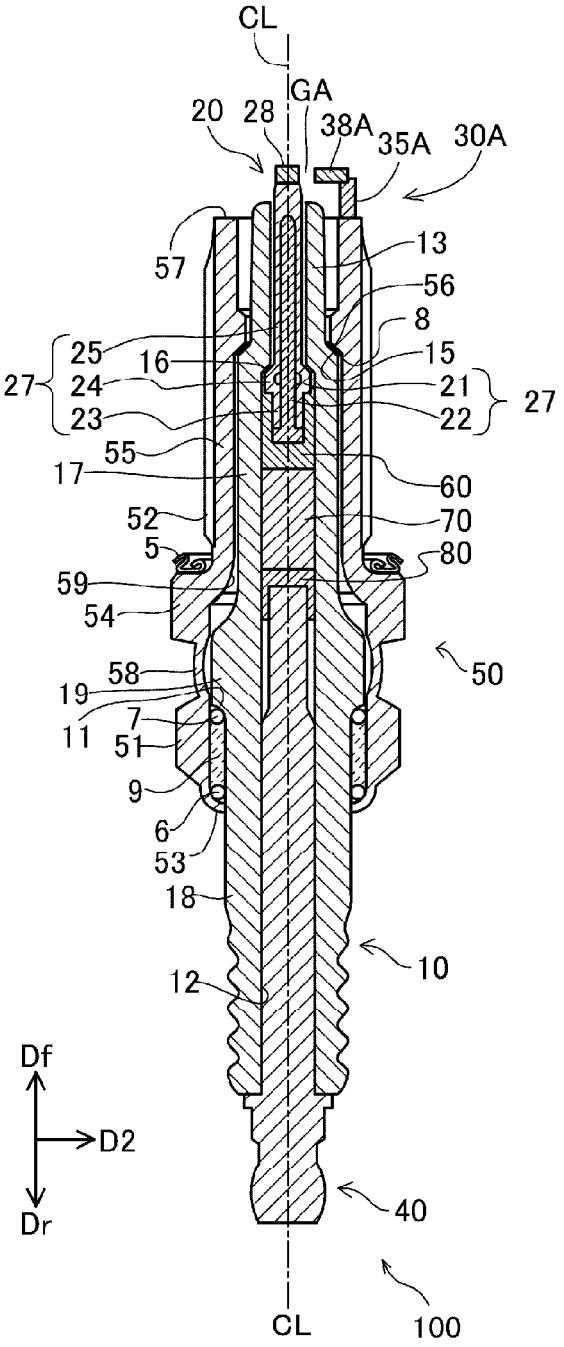
FIG. 3 is a sectional view of the spark plug 100.

Next, the structure of the spark plug 100 will be described. FIG. 3 is a sectional view of an example of a spark plug. In FIG. 3, the center axis CL of the center electrode 20 is shown. In the present embodiment, the center axis CL of the center electrode 20 is the same as the center axis of the spark plug 100. The illustrated section contains the center axis CL. In the following description, the direction parallel to the center axis CL will also be referred to as the "axial direction." The radial direction of a circle whose center is located at the center axis CL will simply be referred to the "radial direction," and the circumferential direction of a circle whose center is located at the center axis CL will simply be referred to the "circumferential direction." Of directions parallel to the center axis CL, the upward direction in FIG. 3 will be referred to as a forward direction Df, and the downward direction will be referred to as a rearward direction Dr. The forward direction Df side of FIG. 3 will be referred to as the forward end side of the spark plug 100, and the rearward direction Dr side of FIG. 3 will be referred to as the rear end side of the spark plug 100.

The spark plug 100 includes an insulator 10 (hereinafter also referred to as the "ceramic insulator 10"), a center electrode 20, two ground electrodes, a metallic terminal 40, a metallic shell 50, an electrically conductive first seal portion 60, a resistor 70, an electrically conductive second seal portion 80, a forward-end-side packing 8, talc 9, a first rear-end-side packing 6, and a second rear-end-side packing 7. The two ground electrodes are a first ground electrode 30A and a second ground electrode 30B, which is not shown in FIG. 3.

The insulator 10 is a generally cylindrical member having a through hole 12 (hereinafter also referred to as the "axial hole 12") extending along the center axis CL and penetrating the insulator 10. The insulator 10 is formed by firing alumina (other insulating materials can be employed). The insulator 10 has a leg portion 13, a first outer-diameter decreasing portion 15, a forward-end-side trunk portion 17, a flange portion 19, a second outer-diameter decreasing portion 11, and a rear-end-side trunk portion 18, which are arranged in this order from the forward end side toward the rearward direction Dr side. The outer diameter of the first outer-diameter decreasing portion 15 decreases gradually from the rear end side toward the forward end side. An inner-diameter decreasing portion 16 whose inner diameter decreases gradually from the rear end side toward the forward end side is formed in the vicinity of the first outer-diameter decreasing portion 15 of the insulator 10 (at the forward-end-side trunk portion 17 in the example of FIG. 3). The outer diameter of the second outer-diameter decreasing portion 11 decreases gradually from the forward end side toward the rear end side.

The rod-shaped center electrode 20 extending along the center axis CL is inserted into a forward end portion of the axial hole 12 of the insulator 10. The center electrode 20 has a shaft portion 27 and a generally circular columnar center electrode tip 28 whose center coincides with the center axis CL and which extends along the center axis CL. The shaft portion 27 has a leg portion 25, a flange portion 24, and a head portion 23 which are arranged in this order from the forward end side toward the rearward direction Dr side. The center electrode tip 28 is joined to the forward end of the leg portion 25 (namely, the forward end of the shaft portion 27) (by means of, for example, laser welding). The entirety of the center electrode tip 28 is exposed to the outside of the axial hole 12 on the forward end side of the insulator 10. A surface of the flange portion 24 on the forward direction Df side is supported by the inner-diameter decreasing portion 16 of the insulator 10. The shaft portion 27 includes an outer layer 21 and a core 22. The outer layer 21 is formed of a material which has electrical conductivity and is higher in oxidation resistance than the core 22; namely, a material which consumes little when it is exposed to combustion gas within a combustion chamber of an internal combustion engine (for example, pure nickel, an alloy containing nickel and chromium, etc.). The core 22 is formed of a material which has electrical conductivity and is higher in thermal conductivity than the outer layer 21 (for example, pure copper, a copper alloy, etc.). A rear end portion of the core 22 is exposed from the outer layer 21, and forms a rear end portion of the center electrode 20. The remaining portion of the core 22 is covered with the outer layer 21. However, the entirety of the core 22 may be covered with the outer layer 21. The center electrode tip 28 is formed of a material which is higher in durability against discharge than the shaft portion 27. Examples of such a material include noble metals (e.g., iridium (Ir) and platinum (Pt)), tungsten (W), and an alloy containing at least one type of metal selected from these metals.

A portion of the metallic terminal 40 is inserted into a rear end portion of the axial hole 12 of the insulator 10. The metallic terminal 40 is formed of an electrically conductive material (for example, metal such as low-carbon steel).

The resistor 70, which has a generally circular columnar shape and is adapted to suppress electrical noise, is disposed in the axial hole 12 of the insulator 10 to be located between the metallic terminal 40 and the center electrode 20. The resistor 70 is formed through use of, for example, a material containing an electrically conductive material (e.g., particles of carbon), particles of ceramic (e.g., $ZrO_2$), and particles of glass (e.g., particles of $SiO_2$—$B_2O_3$—$Li_2O$—BaO glass). The electrically conductive first seal portion 60 is disposed between the resistor 70 and the center electrode 20, and the electrically conductive second seal portion 80 is disposed between the resistor 70 and the metallic terminal 40. The seal portions 60 and 80 are formed through use of a material containing, for example, particles of glass similar to that contained in the material of the resistor 70 and particles of metal (e.g., Cu). The center electrode 20 and the metallic terminal 40 are electrically connected through the resistor 70 and the seal portions 60 and 80.

The metallic shell 50 is a generally cylindrical member having a through hole 59 which extends along the center axis CL and penetrates the metallic shell 50. The metallic shell 50 is formed of low-carbon steel (other electrically conductive materials (e.g., metallic material) can be employed). The insulator 10 is inserted into the through hole 59 of the metallic shell 50. The metallic shell 50 is disposed around the insulator 10. On the forward end side of the metallic shell 50, the forward end of the insulator 10 (a forward end portion of the leg portion 13 in the present embodiment) is exposed to the outside of the through hole 59. On the rear end side of the metallic shell 50, the rear end of the insulator 10 (a rear end portion of the rear-end-side trunk portion 18 in the present embodiment) is exposed to the outside of the through hole 59.

The metallic shell 50 has a trunk portion 55, a seat portion 54, a deformable portion 58, a tool engagement portion 51, and a crimp portion 53 arranged in this order from the forward end side toward the rear end side. The seat portion 54 is a flange-shaped portion. A screw portion 52 for screw engagement with an attachment hole of an internal combustion engine (e.g., gasoline engine) is formed on the outer circumferential surface of the trunk portion 55. The nominal diameter of the screw portion 52 is, for example, M12 (12 mm) However, the nominal diameter of the screw portion 52 may be M8, M10, M14, or M18. An annular gasket 5 formed by folding a metal plate is fitted between the seat portion 54 and the screw portion 52.

The metallic shell 50 has an inner-diameter decreasing portion 56 disposed on the forward direction Df side of the deformable portion 58. The inner diameter of the inner-diameter decreasing portion 56 decreases gradually from the rear end side toward the forward end side. The forward-end-side packing 8 is sandwiched between the inner-diameter decreasing portion 56 of the metallic shell 50 and the first outer-diameter decreasing portion 15 of the insulator 10. The forward-end-side packing 8 is an O-ring formed of iron (other materials (e.g., metallic material such as copper) can be employed).

The tool engagement portion 51 has a shape (e.g., a hexagonal column) suitable for engagement with a spark plug wrench. The crimp portion 53 is disposed on the rear end side of the second outer-diameter decreasing portion 11 of the insulator 10, and forms a rear end (an end on the rearward direction Dr side) of the metallic shell 50. The crimp portion 53 is bent radially inward. On the forward direction Df side of the crimp portion 53, the first rear-end-side packing 6, the talc 9, and the second rear-end-side packing 7 are disposed between the inner circumferential surface of the metallic shell 50 and the outer circumferential surface of the insulator 10 in this order toward the forward direction Df side. In the present embodiment, these rear-end-side packings 6 and 7 are C-rings formed of irons (other materials can be employed).

When the spark plug 100 is manufactured, crimping is performed such that the crimp portion 53 is bent inward. Thus, the crimp portion 53 is pressed toward the forward direction Df side. As a result, the deformable portion 58 deforms, and the insulator 10 is pressed forward within the metallic shell 50 via the rear-end-side packings 6 and 7 and the talc 9. The forward-end-side packing 8 is pressed between the first outer-diameter decreasing portion 15 and the inner-diameter decreasing portion 56 to thereby establish a seal between the metallic shell 50 and the insulator 10. By virtue of the above-described configuration, the metallic shell 50 is fixed to the insulator 10.

Figure 4A:
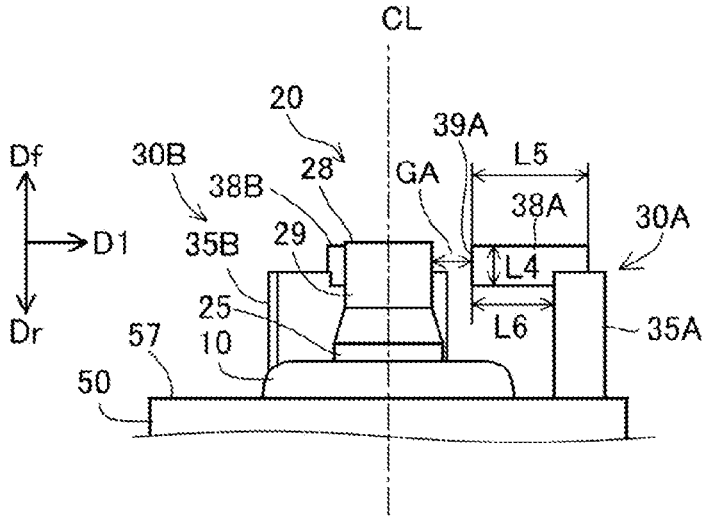
FIGS. 4(A) and 4(B) are views showing the structure of a portion of the spark plug 100 near the forward end thereof.
Figure 4B:
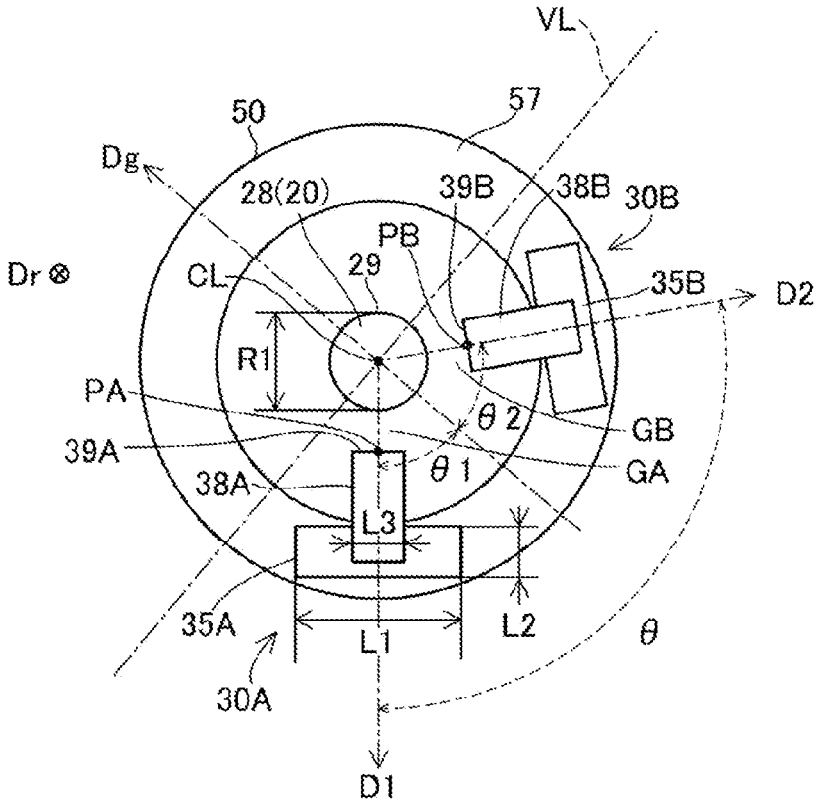

FIGS. 4(A) and 4(B) are views showing the structure of a portion of the spark plug 100 near the forward end thereof. FIG. 4(A) shows a view obtained by viewing the portion of the spark plug 100 near the forward end thereof in a direction perpendicular to the axial line CL. FIG. 4(B) shows a view obtained by viewing the portion of the spark plug 100 near the forward end thereof from the forward end side toward rear end side along the axial line CL. In FIG. 4(B), in order to simplify the drawing, the structures of the insulator 10 and the center electrode 20, excluding the center electrode tip 28, are not shown. The first ground electrode 30A includes a first ground electrode main body 35A and a first ground electrode tip 38A.

The first ground electrode main body 35A has a rectangular parallelepiped shape, and is formed of an electrically conducive material which is excellent in oxidation resistance (for example, an alloy containing nickel and chromium). The rear end of the first ground electrode main body 35A is joined to the forward end surface 57 of the metallic shell 50 (for example, resistance welding). Accordingly, the first ground electrode main body 35A is electrically connected to the metallic shell 50. As shown in FIG. 4(B), the cross section of the first ground electrode main body 35A taken along a plane perpendicular to the axial line CL has a rectangular shape. The first ground electrode main body 35A is joined to the metallic shell 50 in such a manner that the longer sides of the rectangle extend along the circumferential direction, and the shorter sides of the rectangle extend along the radial direction.

The first ground electrode tip 38A has the shape of a rectangular column extending in the radial direction, and is formed of an electrically conductive material which is more excellent in durability against discharge than the first ground electrode main body 35A (for example, a noble metal such as iridium (Ir), platinum (Pt), or the like, tungsten (W), or an alloy containing at least one of these metals). An end of the first ground electrode tip 38A located on the outer side in the radial direction is joined to the forward end surface of the first ground electrode main body 35A (for example, resistance welding). The joint position is located at the centers of the longer sides of the rectangular forward end surface of the first ground electrode main body 35A. As a result, as shown in FIG. 4(B), the shape of the first ground electrode 30A as viewed along the axial line CL is a T-like shape. Also, as shown in FIG. 4(A), the shape of the first ground electrode 30A as viewed along a specific direction perpendicular to the axial line CL is an L-like shape.

A surface 39A of the first ground electrode tip 38A located on the inner side in the radial direction faces a side surface 29 (also referred as a discharge side surface) of the circular columnar center electrode tip 28 in the radial direction to thereby form a first gap GA. The surface 39A of the first ground electrode tip 38A located on the inner side in the radial direction will also be referred to as a first discharge surface 39A. As shown in FIG. 4(B), a direction which is directed from the axial line CL toward the point PA of the center of the first discharge surface 39A in the width direction (in the present embodiment, a direction along the circumferential direction) and is perpendicular to the axial line CL will be referred as a first disposition direction D1 showing the direction of the location where the first ground electrode 30A is disposed.

The shape, material, and dimensions of the second ground electrode 30B are the same as those of the first ground electrode 30A. Namely, the second ground electrode 30B includes a second ground electrode main body 35B identical with the first ground electrode main body 35A, and a second ground electrode tip 38B identical with the first ground electrode tip 38A.

A surface 39B of the second ground electrode tip 38B located on the inner side in the radial direction faces the side surface 29 of the circular columnar center electrode tip 28 in the radial direction to thereby form a second gap GB (FIG. 4(B)). The surface 39B of the second ground electrode tip 38B located on the inner side in the radial direction will also be referred to as a second discharge surface 39B.

As shown in FIG. 4(B), a direction which is directed from the axial line CL toward the point PB of the center of the second discharge surface 39B in the width direction and is perpendicular to the axial line CL will be referred as a second disposition direction D2 showing the direction of the location where the second ground electrode 30B is disposed.

The angle between the first disposition direction D1 and the second disposition direction D2 as measured in the circumferential direction; i.e., the inferior angle (smaller angle) formed between a line connecting the axial line CL and the point PA and a line connecting the axial line CL and the point PB, will be referred to as a disposition angle θ of the two ground electrodes 30A and 30B. The disposition angle θ is sufficiently smaller than 180 degrees (about 100 degrees)(° in the example shown in FIGS. 4(A) and 4(B)).

Notably, it is preferred to attach the spark plug 100 to the internal combustion engine 700 such that the upper side of the flow direction Dg (FIG. 2) of an air-fuel mixture within a region of the combustion chamber 790 in the vicinity of the forward end of the spark plug 100 is located within the range of the disposition angle θ shown in FIG. 4(B). When the spark plug 100 is attached in the above-described manner, as will be described in detail later, spark blowout caused by the flow of the air-fuel mixture in the flow direction Dg (a gas flow AR1 which will be described later) can be suppressed effectively, whereby the durability and ignition performance of the spark plug 100 can be enhanced. The flow direction Dg of the air-fuel mixture in the vicinity of the forward end of the spark plug 100 can be said as a flow direction of the flow passage of the air-fuel mixture passing through the first gap GA and the second gap GB. It is more preferred that, as shown in FIG. 4(B), the spark plug 100 be attached to the internal combustion engine 700 in such a manner that an angle θ1 which is a smaller one of the angles formed between a line parallel to the flow direction Dg and passing through the axial line CL (flow direction line) and the first disposition direction D1 as measured in the circumferential direction becomes approximately the same as an angle θ2 which is a smaller one of the angles formed between the flow direction line and the second disposition direction D2 as measured in the circumferential direction.

Also, as described above, the disposition angle θ is sufficiently smaller than 180 degrees, and the spark plug 100 does not have ground electrodes other than the first ground electrode 30A and the second ground electrode 30B. Therefore, the spark plug 100 has a specific plane which includes the axial line CL and which bisects the metallic shell 50 in such a manner that all the ground electrodes (i.e., the first ground electrode 30A and the second ground electrode 30B) are located on one side of the plane. For example, in the example shown in FIG. 4(B), all the ground electrodes are present on one side of a plane VL indicated by a broken line (in a lower right side of FIG. 4(B)), and no ground electrode is present on the other side of the plane VL (in an upper left side of FIG. 4(B)).

Notably, the outer diameter of the center electrode tip 28; i.e., the outer diameter of the center electrode 20 at a position in the axial direction at which the center electrode 20 faces the discharge surfaces 39A and 39B of the ground electrodes 30A and 30B is represented by R1. Also, the length of the ground electrode main bodies 35A and 35B in the width direction (a direction along the circumferential direction in the present embodiment) (i.e., the length in the longitudinal direction in a cross section perpendicular to the axis, also referred to as the largest width) is represented by L1. The length of the ground electrode main bodies 35A and 35B in the radial direction (i.e., the length in the lateral direction in the cross section perpendicular to the axis, also referred to as the smallest width) is represented by L2. Also, the length of the discharge surfaces 39A and 39B of the ground electrode tips 38A and 38B in the width direction (i.e., the length of the discharge surfaces in the longitudinal direction, also referred to as the largest width) is represented by L3; the length of the discharge surfaces 39A and 39B in the axial direction is represented by L4, and the length of the ground electrode tips 38A and 38B in the radial direction is represented by L5. Also, the projection length by which the ground electrode tips 38A and 38B project radially inward from the ground electrode main bodies 35A and 35B is represented by L6.

Figure 5:
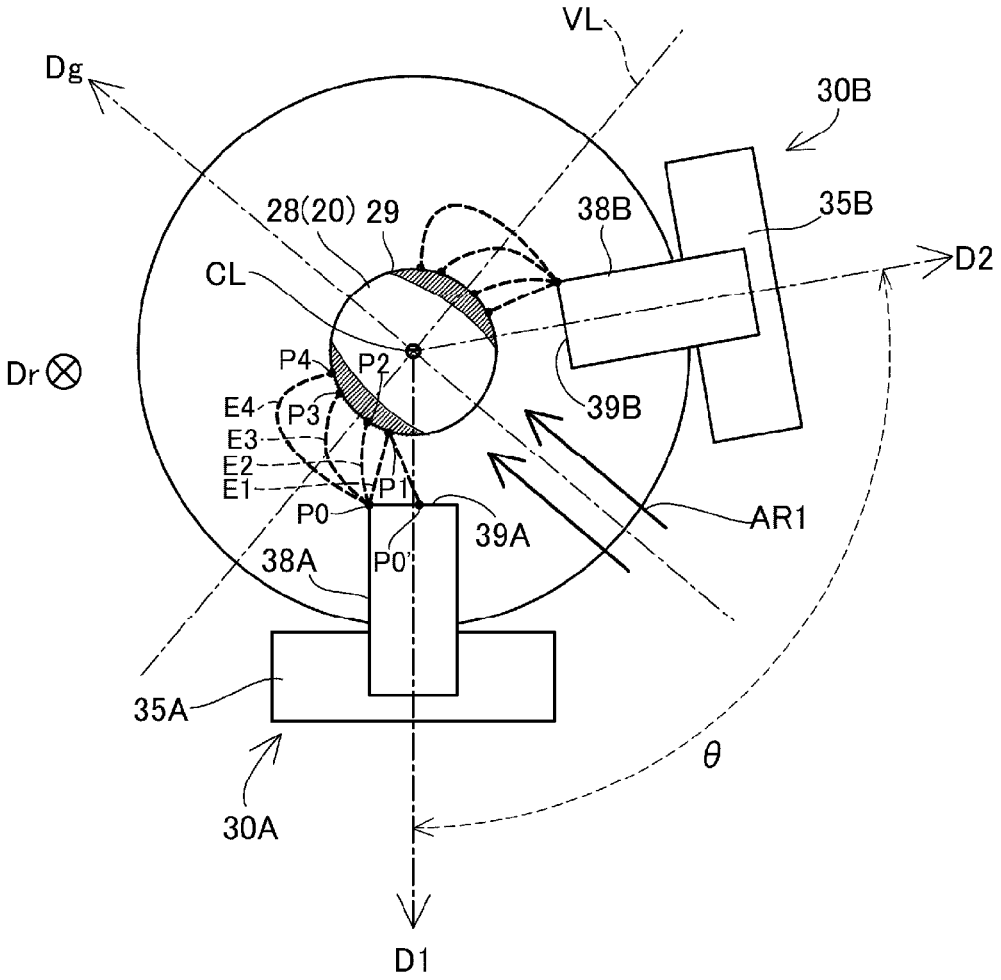
FIG. 5 is a view used for describing discharge in the spark plug 100 of the embodiment.

According to the above-described spark plug 100 of the embodiment, the ignition performance and durability can be enhanced by properly disposing the two ground electrodes 30A and 30B. This will be described more specifically with reference to FIG. 5. FIG. 5 is a view used for describing discharge in the spark plug 100 of the embodiment. Like FIG. 4(B), FIG. 5 shows a view of a portion of the spark plug 100 in the vicinity of the forward end thereof as viewed along the axial line CL from the forward end side toward the rear end side. In FIG. 5, the structures of components other than the center electrode tip 28, the first ground electrode 30A, and the second ground electrode 30B are omitted appropriately.

Arrows AR1 in FIG. 5 represent the flow of the air-fuel mixture in the vicinity of the first gap GA and the second gap GB (namely, the flow of the air-fuel mixture within the combustion chamber 790 of the internal combustion engine 700) (hereinafter referred to as a "gas flow AR1"). This gas flow AR1 is a flow which passes through the first gap GA and the second gap GB along the flow direction Dg. The spark discharge generated at the first gap GA or the second gap GB when the spark plug 100 is operated may be blown leeward by this gas flow AR1.

Discharge paths E1 through E4 in FIG. 5 show an example of the discharge path of spark generated at the first gap GA. The first path E1 is an example of the discharge path immediately after the generation of spark. The first path E1 is a path connecting, for example, a point P0 at an end of the first discharge surface 39A where spark is likely to be generated and a point P1 on the discharge side surface 29 closest to the point P0. Since the generated spark is blown and caused to flow by the gas flow AR1 (flow of blown spark), the path of spark changes to the second path E2, to the third path E3, and to the fourth path E4 with elapse of time. At that time, the end point P2-P4 of the path of spark on the discharge side surface 29 moves toward the downstream side of the gas flow AR1 along the discharge side surface 29. Since the discharge side surface 29 is a curved surface, such movement of the end point occurs smoothly. Therefore, occurrence of a phenomenon in which spark quenches due to the flow of blown spark (spark blowout) can be suppressed. Also, due to the flow of blown spark, the discharge paths of spark are extended, and flame kernels are formed at positions away from the gaps GA and GB. Therefore, flame quenching is less likely to occur. As a result, the ignition performance of the spark plug 100 is enhanced. Notably, the end of the first path E1 on the first discharge surface 39A is not limited to the point P0 and may be a point P0' located on the upstream side of the point P0. In this case as well, the end of the first path E1 on the first discharge surface 39A moves to the point P0 due to the gas flow AR1.

Also, the spark blowout may cause a phenomenon (multiple discharge) in which spark is gain generated along the first path E1 during a period during which discharge must be generated only one time. Since the maximum voltage is applied to the gap and the maximum current flows through the gap when spark is generated, the amounts of consumption of the electrode tips 28, 38A, and 38B become maximum when spark is generated. Therefore, if multiple discharge occurs, the consumption amounts of the electrode tips 28, 38A, and 38B become larger than those in the case where multiple discharge does not occur. According to the present embodiment, since the spark blowout is suppressed as described above, increases in the consumption amounts of the electrode tips 28, 38A, and 38B can be suppressed. As a result, the durability of the spark plug 100 is enhanced. The same thing can be said about the spark generated at the second gap GB.

Further, since the two ground electrodes 30A and 30B are locally present on one side of the plane VL; i.e., on the upstream side of the gas flow AR1, the end point (for example, P2-P4) of the discharge path of spark on the discharge side surface 29 of the center electrode tip 28 does not locally appear within a small region of the discharge side surface 29, but appears within a relative large region. As a result, as indicated by cross-hatching in FIG. 5, the center electrode tip 28 is consumed relatively uniformly without being consumed excessively locally. As a result, the durability of the spark plug 100 is enhanced. The case where θ is, for example, 180 degrees or greater than 180 degrees; namely, the case where the two ground electrodes 30A and 30B are located on the plane VL or on the downstream side of the plane VL in the direction of the gas flow AR1 will be considered. In this case, the region of the discharge side surface 29 of the center electrode tip 28 within which consumption of the center electrode tip 28 occurs is considered to be present locally on the downstream side of the plane VL. Therefore, the durability is considered to be inferior to that of the present embodiment.

Such effect is effective particularly in the case where the speed of the gas flow AR1 is relatively high. Specifically, when the degree of leanness of the air-fuel mixture is increased (the A/F ratio is increased), exhaust gas recirculation (EGR) is performed, and/or the pressure within the combustion chamber is increased, the speed of the gas flow AR1 within a combustion chamber tends to be increased in order to secure the required ignition performed. The effects of the spark plug 100 of the present embodiment become remarkable, when the spark plug 100 is used for an internal combustion engine in which the speed of such a gas flow AR1 is made relatively high. Specifically, from the viewpoint of suppressing the spark blowout, it is preferred that the discharge path of spark be short, and if the spark blowout does not occur, from the viewpoint of ignition performance, it is preferred that the discharge path of spark be long. It has been difficult to simultaneously satisfy the demands contrary to each other. However, in the spark plug 100 of the present embodiment, by properly determining the layout of the ground electrodes, etc., the spark blowout can be suppressed even when the discharge path of spark becomes long. As a result, even in the case where the speed of the spark gas flow AR within the combustion chamber is high, the required ignition performance and durability of the spark plug can be secured.

B. First Evaluation Test

In order to evaluate the performance of the spark plug 100 of the embodiment, evaluation of ignition performance was performed through use of samples. Specifically, in the first evaluation test, the case where the direction of discharge is perpendicular to the axial direction (lateral discharge) and the case where the direction of discharge is parallel to the axial direction (longitudinal discharge) were compared.

Figure 6A:
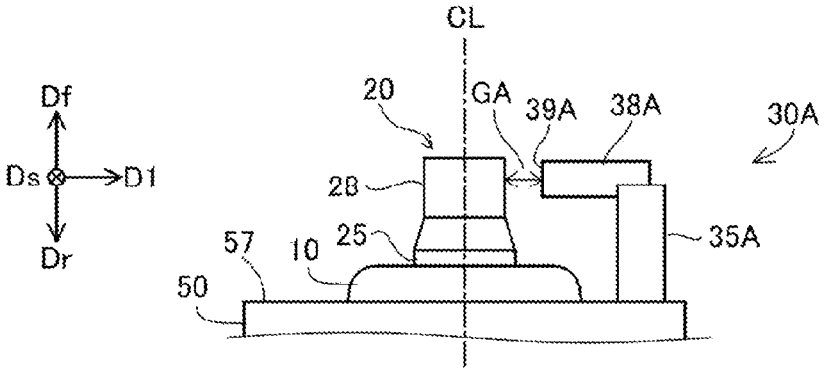
FIGS. 6(A) through 6(C) are views used for describing samples S1 through S3 used in a first evaluation test.
Figure 6B:
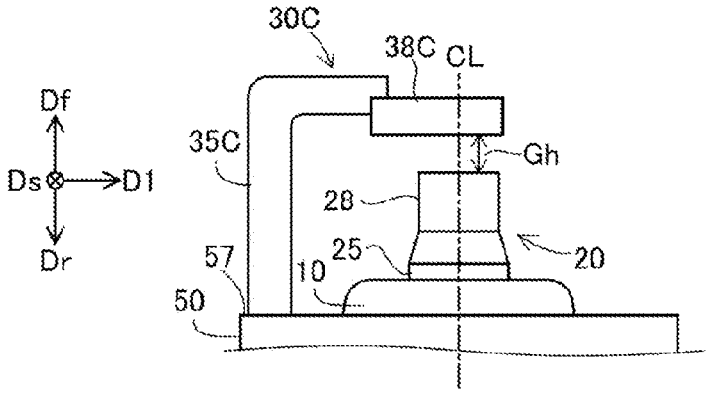
Figure 6C:
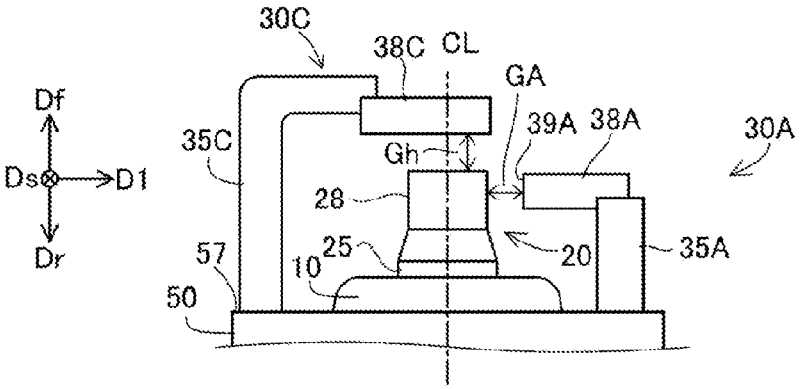

FIGS. 6(A) through 6(C) are views used for describing samples S1 through S3 used in the first evaluation test. The sample S1 shown in FIG. 6(A) and adapted to lateral discharge is a spark plug obtained by removing the second ground electrode 30B from the spark plug 100 of the above-described embodiment. Namely, the sample S1 has a single first ground electrode 30A only as a ground electrode. The structure of the remaining portion is the same as that of the spark plug 100 of the above-described embodiment.

The sample S2 shown in FIG. 6(B) and adapted to longitudinal discharge has a single longitudinal discharge ground electrode 30C only as a ground electrode. The structure of the remaining portion is the same as that of the spark plug 100 of the above-described embodiment. The ground electrode 30C has an L-shaped ground electrode main body 35C and a ground electrode tip 38C. The rear end of an axially extending portion of the ground electrode main body 35C is joined to the metallic shell 50 (for example, resistance welding). The ground electrode tip 38C is joined to an end of a radially extending portion of the ground electrode main body 35C, which end is located on the inner side in the radial direction (for example, resistance welding). The rear end surface of the ground electrode tip 38C forms a gap Gh in cooperation with the forward end surface of the center electrode tip 28.

The sample S3 of FIG. 6(C) adapted for discharge in lateral and longitudinal directions has two ground electrodes; i.e., one first ground electrode 30A for lateral discharge and one ground electrode 30C for longitudinal discharge. The first ground electrode 30A for lateral discharge of the sample S3 is the same as the first ground electrode 30A of the sample S1. The ground electrode 30C for longitudinal discharge of the sample S3 is the same as the ground electrode 30C of the sample S2. The structure of the remaining portion is the same as that of the spark plug 100 of the above-described embodiment. Notably, the two ground electrodes 30A and 30C are disposed along a single straight line passing through the axial line CL (straight line parallel to the direction D1 in FIG. 6(C)). Namely, the two ground electrodes 30A and 30C are joined to the forward end surface 57 of the metallic shell 50 at positions located on opposite sides with respect to the axial line CL.

Notably, the specific structures of the samples S1 through S3 are as follows.

The outer diameter R1 of the center electrode tip 28: 0.6 mm

The material of the center electrode tip 28: iridium (Ir) alloy

The length L3 of the discharge surfaces of the ground electrode tips 38A and 38C in the circumferential direction: 0.6 mm The length L4 of the discharge surfaces of the ground electrode tips 38A and 38C in the axial direction: 0.6 mm The length L5 of the ground electrode tips 38A and 38C in the radial direction: 1.0 mm The material of the ground electrode tips 38A and 38C: platinum (Pt) alloy Notably, three types of samples S11 through S13 in which the gap GA (FIG. 6(A)) was set to 0.3 mm, 0.5 mm, and 1.0 mm, respectively, were prepared as the sample S1 for lateral discharge. Also, three types of samples S21 through S23 in which the gap Gh (FIG. 6(B)) was set to 0.3 mm, 0.5 mm, and 1.0 mm, respectively, were prepared as the sample S2 for longitudinal discharge. Also, three types of samples S31 through S33 in which each of the gap GA and gap Gh (FIG. 6(C)) was set to 0.3 mm, 0.5 mm, and 1.0 mm, respectively, were prepared as the sample S3 for discharge in longitudinal and lateral direction.

In the first evaluation test, a spark test of generating spark discharge 100 times per test within a chamber pressurized to 0.8 MPa was performed through use of the nine types of samples S11 through S33. At the time of discharge, an electrical energy of 50 mJ per discharge was supplied to each sample through use of a predetermined ignition apparatus (for example, a full transistor ignition apparatus). During the spark test, an air flow was generated within the camber such that air flowed in a direction (direction Ds in FIGS. 6(A) through 6(C)) perpendicular to the direction in which the ground electrode is disposed as viewed from the axial line CL.

Of the 100 times of spark discharges, the number of times multiple discharge due to spark blowout occurred was counted. By performing the spark test a plurality of times while changing the flow speed of air within the chamber by 1 m/s at a time, the lower limit of the flow speed (hereinafter also referred to as the "lower limit flow speed") at which the ratio of occurrence of spark blowout (multiple discharge) becomes 5% or greater was specified as an evaluation value of each sample. Table 1 shows the results of the first evaluation test.

TABLE 1

| Sample No. | Gap length (mm) | Lower limit flow speed (m/s) |
|---|---|---|
| S11 | 0.3 | 10 |
| S12 | 0.5 | 8 |
| S13 | 1 | 6 |
| S21 | 0.3 | 5 |
| S22 | 0.5 | 4 |
| S23 | 1 | 3 |
| S31 | 0.3 | 5 |
| S32 | 0.5 | 4 |
| S33 | 1 | 3 |

The results mean that the higher the lower limit flow speed, the smaller the possibility of occurrence of spark blowout, and the higher the durability and ignition performance.

As can be understood from Table 1, in the cases of the samples S11 through S13 for lateral discharge, irrespective of the length of the gap, the lower limit flow speed is higher, and spark blowout is less like to occur as compared with the samples S21 through S23 for longitudinal discharge.

Figure 7:
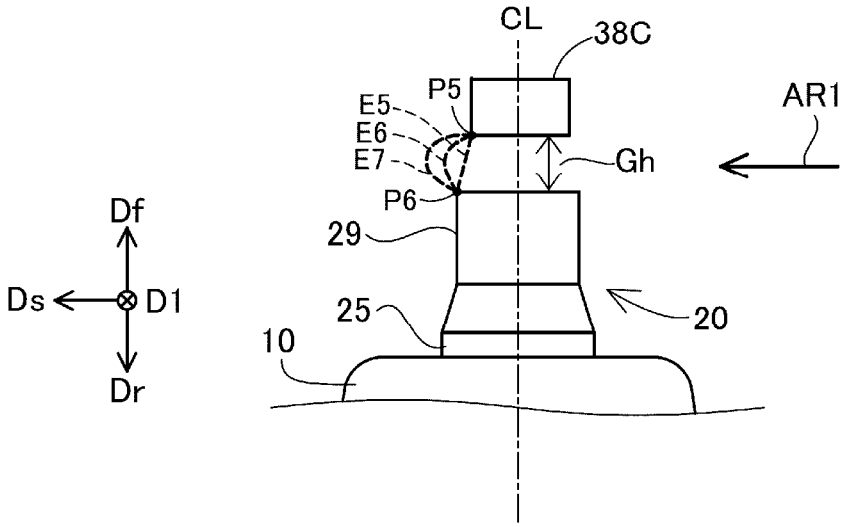
FIG. 7 is a view used for describing discharge in a sample for longitudinal discharge.

FIG. 7 is a view used for describing discharge in a sample for longitudinal discharge. Discharge paths E5 through E7 in FIG. 7 show an example of the discharge path of spark generated at the gap Gh. The path E5 is an example of the path immediately after the generation of spark. The path E5 is a path connecting, for example, a point P6 located at an end of the discharge surface (forward end surface) of the center electrode tip 28 where spark is likely to be generated and a point P5 located at an end of the discharge surface (rear end surface) of the ground electrode tip 38C. Since the generated spark is blown by a gas flow AR1 (flow of blown spark), the path of spark changes to the path E6 and to the path E7 with elapse of time. At that time, the end point P5 of the path of spark on the discharge side surface 29 of the center electrode tip 28 cannot move toward the downstream side of the gas flow AR1 unlike the case of lateral discharge (see FIG. 5). As a result, conceivably, in the case of discharge in the longitudinal direction, spark blowout is more likely to occur as compared with the case of discharge in the lateral direction.

Also, as can be understood from Table 1, in the cases of the samples S11 through S13 for lateral discharge, irrespective of the length of the gap, the lower limit flow speed is higher, and spark blowout is less likely to occur as compared with the samples S31 through S33 for discharge in the longitudinal and lateral directions. Also, in terms of the lower limit flow speed and the likelihood of occurrence of spark blowout, no difference was observed between the samples S21 through S23 for longitudinal discharge the samples S31 through S33 for discharge in the longitudinal and lateral directions. Conceivably, this is because, in the samples for discharge in the longitudinal and lateral directions, most of spark discharges actually generated are the longitudinal discharge. Namely, the longitudinal discharge is generated along a path which connects an end (corner) of the discharge surface of the center electrode tip 28 and an end (corner) of the discharge surface of the ground electrode tip 38C. Therefore, conceivably, the dielectric breakdown voltage of the gap Gh for longitudinal discharge is lower than the dielectric breakdown voltage of the gap GA for lateral discharge. Therefore, it is considered that, in the samples for discharge in the longitudinal and lateral directions, longitudinal discharge is more likely to occur as compared with lateral discharge.

From the first evaluation test, it was found that employment of lateral discharge as in the spark plug 100 of the embodiment is preferred in order to suppress occurrence of spark blowout, to thereby enhance the durability and ignition performance of the spark plug.

C. Second Evaluation Test

Next, in order to determine a proper value of the disposition angle θ (FIG. 4) of the two ground electrodes of the spark plug 100 of the embodiment, evaluation of ignition performance was performed through use of samples. In the second evaluation test, evaluation was performed through use of six types of sample S41 through S46 of the spark plug 100 (see FIG. 4) of the embodiment and three types of samples (referred to as comparative samples) S51 through S53 of a spark plug of a comparative embodiment.

Figure 8:
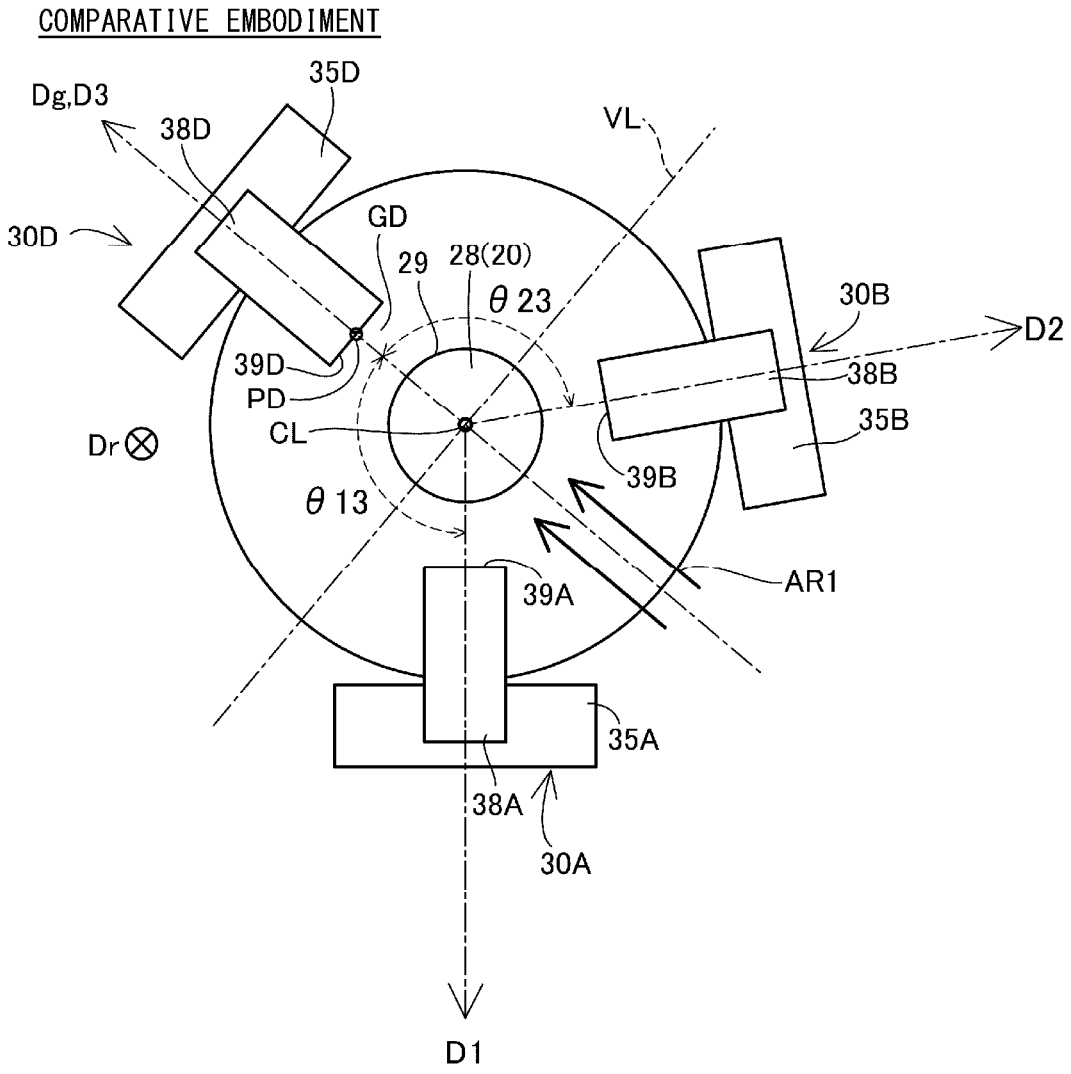
FIG. 8 is a explanatory view of a spark plug of a comparative embodiment.

FIG. 8 is an explanatory view of the spark plug of the comparative embodiment. The spark plug of the comparative embodiment includes a third ground electrode 30D in addition to the structural components of the spark plug 100. The shape, material, and dimensions of the third ground electrode 30D are the same as those of the remaining two ground electrodes 30A and 30B. Namely, the third ground electrode 30D includes a third ground electrode main body 35D identical with the first ground electrode main body 35A and a third ground electrode tip 38D identical with the first ground electrode tip 38A.

A surface 39D (also referred to as a third discharge surface 39D) of the third ground electrode tip 38D located on the inner side in the radial direction faces the side surface 29 of the circular columnar center electrode tip 28 to thereby form a third gap GD (FIG. 8). As shown in FIG. 8, a direction which is directed from the axial line CL toward the point PD of the center of the third discharge surface 39D in the width direction and is perpendicular to the axial line CL will be referred as a third disposition direction D3 showing the direction of the location where the third ground electrode 30D is disposed.

In the spark plug of the comparative embodiment, the third disposition direction D3 is determined such that the angle θ13 between the first disposition direction D1 and the third disposition direction D3 in the circumferential direction and the angle θ23 between the second disposition direction D2 and the third disposition direction D3 in the circumferential direction satisfy a relation of θ13=θ23>90 degrees. The third ground electrode 30D disposed in the third disposition direction D3 is located on the side opposite the first ground electrode 30A and the second ground electrode 30B with respect to a plane VL which is perpendicular to the third disposition direction D3 and includes the axial line CL. In other words, the third ground electrode 30D is located on the downstream side of the flow direction Dg of the air-fuel mixture (downstream side of the gas flow AR1) when the spark plug of the comparative embodiment is attached to the internal combustion engine.

Notably, the six types of samples S41 through S46 of the embodiment and the three types of comparative samples S51 through S53 are the same in the following aspects.

The outer diameter R1 of the center electrode tip 28: 0.6 mm

The material of the center electrode tip 28: iridium (Ir) alloy

The length L1 of the ground electrode main bodies 35A and 35B in the circumferential direction: 1.0 mm The length L3 of the discharge surfaces of the ground electrode tips 38A and 38B in the circumferential direction: 0.6 mm The length L4 of the discharge surfaces of the ground electrode tips 38A and 38B in the axial direction: 0.6 mm The length L5 of the ground electrode tips 38A and 38B in the radial direction: 1.0 mm The projection length L6 of the ground electrode tips 38A and 38B: 0.3 mm The material of the ground electrode tips 38A and 38B: platinum (Pt) alloy The length of the gaps GA and GB: 0.3 mm Also, the dimensions and material of the third ground electrode 30D of the three types of comparative samples S51 through S53 are the same as those of the remaining two ground electrodes 30A and 30B, and the length of the third gap GD is the same as those of the remaining two gaps GA and GB (0.3 mm).

The six types of samples S41 through S46 of the embodiment differ from one another in the disposition angle θ of the two ground electrodes 30A and 30B, and have disposition angles of 40 degrees, 50 degrees, 60 degrees, 100 degrees, 150 degrees, and 180 degrees, respectively. The comparative samples S51 through S53 differ from one another in the disposition angle θ of the two ground electrodes 30A and 30B, and have disposition angles of 60 degrees, 100 degrees, and 150 degrees, respectively.

In the second evaluation test, each sample was mounted on an internal combustion engine in such a manner that the flow direction of air-fuel mixture coincides with the flow direction Dg shown in FIG. 4(B), an operation test of operating the internal combustion engine for one minute per measurement was performed, and the ratio of misfire was measured. Specifically, a straight-four gasoline engine having a displacement of 1.5 L was operated at a speed of 1600 rpm. Notably, the indicated means effective pressure of this gasoline engine is 340 kPa. During the operation, an electrical energy of 50 mJ per discharge was supplied through use of a predetermined ignition apparatus.

For a single sample, while the air-fuel ratio (A/F) of air-fuel mixture was changed stepwise, the misfire ratio was measured three times at each air-fuel ratio. From the result obtained by plotting the air-fuel ratio and the misfire ratio, the air-fuel ratio at which each sample exhibited a misfire ratio of 1% was calculated through approximate calculation. Table 2 shows the results of the second evaluation test. The results mean that the larger the air-fuel ratio at the time when the misfire ratio was 1% (hereinafter also referred to as the "air-fuel ratio at the time of 1% misfire ratio"), the higher the ignition performance.

TABLE 2

| Sample No. | Disposition angle θ (degrees) | Air-fuel ratio when misfire ratio was 1% |
|---|---|---|
| S41 | 40 | 22 |
| S42 | 50 | 22.1 |
| S43 | 60 | 23.2 |
| S44 | 100 | 23.5 |
| S45 | 150 | 23.2 |
| S46 | 180 | 22.2 |
| S51 | 60 | 20.9 |
| S52 | 100 | 20.8 |
| S53 | 150 | 20.9 |

As shown in Table 2, it was found that, in the cases of the samples S41 through S46 of the embodiment, irrespective of the disposition angle θ, the air-fuel ratio at the time of 1% misfire ratio is greater by 1 or more than those in the cases of the samples S51 through S53 of the comparative embodiment, and the samples S41 through S46 of the embodiment are excellent in ignition performance.

In the case of the sample of the comparative embodiment (FIG. 8), since the gas flow AR1 (FIG. 8) within the combustion chamber is physically disturbed by the third ground electrode 30D, the speed of the gas flow AR1 in the vicinity of the gaps GA, GB, and GD decreases. As a result, extension of the spark discharge path caused by the flow of spark blown by the gas flow AR1 (FIG. 5) does not occur sufficiently. As a result, expansion of a high temperature region does not occur smoothly, and the generated heat stagnates in the vicinity of the gaps of the spark plug 100 and may be released to the outside through, for example, the spark plug 100. Also, the generated heat is likely to be released to the outside due to heat dissipation through the third ground electrode 30D (quenching action). Also, since spark is generated at the third gap GD, extension of the spark discharge path caused by the flow of blown spark does not occur sufficiently, and the generated heat is more likely to be released to the outside by the quenching action. It is considered that ignition performance does not improve sufficiently due to these factors.

As described above, it was found through the second evaluation test that, from the viewpoint of enhancing ignition performance, it is preferred to dispose the ground electrodes in such a manner that, as in the spark plug 100 of the present embodiment, all the ground electrodes are present on one side of the plane VL indicated by a broken line in FIG. 4(B) (on the lower right side of FIG. 4(B)), and no ground electrode is present on the other side of the plane VL (on the upper left side of FIG. 4(B)).

Further, as shown in Table 2, it was found that, in the cases of the samples S43 through S45 in which the disposition angle θ falls within the range of 60 degrees and 150 degrees, the air-fuel ratio at the time of 1% misfire ratio is greater by 1 or more as compared with the samples S41 and S42 in which the disposition angle θ is smaller than 60 degrees and the sample S46 in which the disposition angle θ is greater than 150 degrees, and the samples S43 through S45 are excellent in ignition performance.

The smaller the disposition angle θ, the narrower the flow path of the gas flow AR1 passing through the gaps GA and GB, and the smaller the amount of the gas flow AR1 in the vicinity of the gaps GA and GB. When the disposition angle θ is smaller than 60 degrees, extension of the spark discharge path caused by the flow of spark blown by the gas flow AR1 (FIG. 5) does not occur sufficiently due to a decrease in the gas flow AR1 passing through the first gaps GA and GB. As a result, conceivably, expansion of a high temperature region does not occur smoothly, and ignition performance does not improve sufficiently.

Also, as the disposition angle θ increases, the position of the path (the first path E1 in FIG. 5) of spark discharge generated at the gaps GA and GB immediately after the generation moves toward the downstream side of the gas flow AR1. Namely, the position of the end point P1 of the first path E1 shown in FIG. 5 moves toward the downstream side of the gas flow AR1. When the disposition angle θ is greater than 150 degrees, the position of the end point P1 of the path E1 immediately after the generation of spark discharge moves excessively toward the downstream side of the gas flow AR1. As a result, a margin distance over which the end point of the path of the spark discharge moves toward the downstream side along the discharge side surface 29 due to the flow of blown spark becomes shorter. As a result, extension of the spark discharge path caused by the flow of spark blown by the gas flow AR1 (FIG. 5) does not occur sufficiently. Accordingly, conceivably, expansion of a high temperature region does not occur smoothly, and ignition performance does not improve sufficiently.

As described above, it was found through the second evaluation test that it is preferred to determine the disposition angle θ of the two ground electrodes 30A and 30B such that a relation of $60° \leq \theta \leq 150°$ is satisfied. Thus, it becomes possible to promote the extension of the spark discharge path caused by the blow-caused flow of spark (FIG. 5) by properly disposing the two ground electrodes. As a result, enhancement of the ignition performance of the spark plug can be realized.

Notably, as shown in Table 1, of the samples whose disposition angles θ satisfy the relation of $60° \leq \theta \leq 150°$, the sample S44 whose disposition angle θ is 100 degrees was the most excellent in ignition performance. As the disposition angle deviated from 100 degrees, the ignition performance decreased gradually. Namely, it was found that as the disposition angle θ, 100 degrees is better than 60 degrees, and is better than 150 degrees.

D. Third Evaluation Test

In the third evaluation test, an evaluation test was performed so as to determine a proper value of the outer diameter R1 of the center electrode tip 28 (the outer diameter R1 of the center electrode). In this third evaluation test, there were used five types of samples S61 through S65 which are the same type as the type of the sample S1 for lateral discharge used in the first evaluation test; namely, samples S61 through S65 which has a single first ground electrode 30A only as a ground electrode. The samples S61 through S65 differ from one another in terms of the outer diameter R1 of the center electrode; i.e., the outer diameters R1 of the center electrodes of the samples S61 through S65 are 0.4 mm, 0.6 mm, 0.8 mm, 1.0 mm, and 1.2 mm, respectively.

The dimensions of the samples S61 through S65, excluding the outer diameter R1 of the center electrode, are identical with those of the sample S11 used in the first evaluation test. For example, the length L3 of the discharge surface 39A of the ground electrode tip 38A in the circumferential direction is 0.6 mm, and the length of the gap GA is 0.3 mm.

In the third evaluation test, a spark test of generating spark discharge 100 times per test within a chamber pressurized to 0.8 MPa was performed for each sample. At the time of discharge, an electrical energy of 50 mJ per discharge was supplied to each sample through use of a predetermined ignition apparatus (for example, a full transistor ignition apparatus). During the spark test, an air flow (flow speed: 10 m/s) was generated within the camber such that air flowed in a direction (direction Ds in FIG. 6(A)) perpendicular to the direction in which the ground electrode is disposed as viewed from the axial line CL.

Of the 100 times of spark discharges, the number of times multiple discharge due to spark blowout occurred was counted, and the incidence of the spark blowout (hereinafter also referred to as the "blown away ratio") was specified as an evaluation value of each sample. The smaller the blown away ratio, the lower the possibility of spark blowout, and the higher the durability and ignition performance. Table 3 shows the results of the third evaluation test.

TABLE 3

| Sample No. | Outer diameter R1 (mm) | Blown away ratio (%) |
|---|---|---|
| S61 | 0.4 | 10 |
| S62 | 0.6 | 5 |
| S63 | 0.8 | 4 |
| S64 | 1 | 2 |
| S65 | 1.2 | 2 |

It was found from Table 3 that, in the samples S62 through S65 in which the outer diameter R1 of the center electrode is equal to or greater than the length L3 (0.6 mm) of the discharge surface 39A of the ground electrode in the width direction, spark blowout is less likely to occur as compared with the sample S61 in which the outer diameter R1 of the center electrode is smaller than the length L3 of the discharge surface 39A of the ground electrode in the width direction.

Further, it was found that, in the samples S63 through S65 in which the outer diameter R1 of the center electrode is greater than the length L3 (0.6 mm) of the discharge surface 39A of the ground electrode in the width direction, spark blowout is less likely to occur as compared with the case of the sample S62 in which the outer diameter R1 of the center electrode is the same as the length L3 of the discharge surface 39A of the ground electrode in the width direction.

The greater the outer diameter R1 of the center electrode, the greater the margin distance over which the position of the end point P1-P4 (FIG. 5) of the path E1-E4 of the spark discharge generated at the gaps GA and GB moves toward the downstream side of the gas flow AR1 along the discharge side surface 29 due to the flow of blown spark. Therefore, in the case where the outer diameter R1 of the center electrode is equal to or greater than the length L3 (0.6 mm in the present experiment) of the discharge surface 39A of the ground electrode in the width direction, it is considered that extension of the spark discharge path caused by the flow of blown spark (FIG. 5) is more likely to occur as compared with the case where the outer diameter R1 is smaller than the length L3. Accordingly, conceivably, expansion of a high temperature region occurs smoothly, and ignition performance improves. Similarly, in the case where the outer diameter R1 of the center electrode is greater than the length L3, it is considered that extension of the spark discharge path caused by the flow of blown spark (FIG. 5) is more likely to occur as compared with the case where the outer diameter R1 is equal to the length L3. Accordingly, conceivably, expansion of a high temperature region occurs smoothly, and ignition performance improves.

As described above, it was found through the third evaluation test that the outer diameter R1 of the center electrode is preferably equal to or greater than the length L3 of the discharge surface 39A of the ground electrode in the width direction, and is more preferably greater than the length L3 of the discharge surface 39A of the ground electrode in the width direction. Thus, extension of the spark discharge path caused by the flow of blown spark (FIG. 5) can be promoted effectively, and ignition performance can be enhanced more.

Notably, as shown in Table 3, of the samples S63 through S65 in which the outer diameter R1 of the center electrode is greater than the length L3, the sample S64 in which the outer diameter R1 of the center electrode is 1 mm was less likely to cause spark blowout as compared with the sample S63 in which the outer diameter R1 of the center electrode is 0.8 mm. The sample S64 in which the outer diameter R1 of the center electrode is 1 mm and the sample S65 in which the outer diameter R1 of the center electrode is 1.2 mm have the same spark blown away ratio. Namely, it was found that an outer diameter R1 of the center electrode greater than 1.5 times the length L3 is further preferred.

E. Fourth Evaluation Test

In the fourth evaluation test, an evaluation test was performed so as to determine a proper value of the largest width (the length L1 in the circumferential direction) of the ground electrode main bodies 35A and 35B. In the fourth evaluation test, there were used six types of samples S71 through S76 of the spark plug 100 (FIG. 4) of the present embodiment. The samples S71 through S76 differ from one another in terms of the length L1 of the ground electrode main bodies 35A and 35B in the circumferential direction; i.e., the lengths L1 of the ground electrode main bodies 35A and 35B of the samples S71 through S76 are 0.6 mm, 1.0 mm, 1.2 mm, 2.0 mm, 2.5 mm, and 3.0 mm, respectively.

Notably, the six types of samples S71 through S76 of the embodiment are the same in the following aspects.

The outer diameter R1 of the center electrode tip 28: 1.0 mm

The material of the center electrode tip 28: iridium (Ir) alloy

The length L3 of the discharge surfaces of the ground electrode tips 38A and 38B in the circumferential direction: 0.6 mm The length L4 of the discharge surfaces of the ground electrode tips 38A and 38B in the axial direction: 0.6 mm The length L5 of the ground electrode tips 38A and 38B in the radial direction: 1.0 mm The projection length L6 of the ground electrode tips 38A and 38B: 0.3 mm The material of the ground electrode tips 38A and 38B: platinum (Pt) alloy The length of the gaps GA and GB: 0.3 mm In the fourth evaluation test, a test identical with the second evaluation test was performed so as to determine the air-fuel ratio at the time of 1% misfire ratio for each sample. Table 4 shows the results of the fourth evaluation test.

TABLE 4

| Sample No. | Length L1 (mm) | Air-fuel ratio when misfire ratio was 1% |
|---|---|---|
| S71 | 0.6 | 22.8 |
| S72 | 1 | 23.4 |
| S73 | 1.2 | 23.7 |
| S74 | 2 | 24.3 |
| S75 | 2.5 | 24 |
| S76 | 3 | 22.7 |

From Table 4 it was found that, in the cases of the samples S72 through S75 in which the length L1 of the ground electrode main bodies 35A and 35B is equal to or greater than the outer diameter R1 (1.0 mm) of the center electrode, the air-fuel ratio at the time of 1% misfire ratio is greater than that in the case of the sample S71 in which the length L1 is smaller than the outer diameter R1 of the center electrode, and the samples S72 through S75 are excellent in ignition performance. Further, it was found that, in the cases of the samples S73 through S75 in which the length L1 of the ground electrode main bodies 35A and 35B is greater than the outer diameter R1 of the center electrode, the air-fuel ratio at the time of 1% misfire ratio is greater than that in the case of the sample S72 in which the length L1 is equal to the outer diameter R1 of the center electrode, and the samples S73 through S75 are excellent in ignition performance. However, an exceptional case was found. Namely, in the case of the sample S76 in which the length L1 of the ground electrode main bodies 35A and 35B is excessively large as compared with the outer diameter R1 of the center electrode, the air-fuel ratio at the time of 1% misfire ratio is smaller than those in the cases of the samples S72 through S75, and the sample S76 is inferior in ignition performance.

Figure 9A:
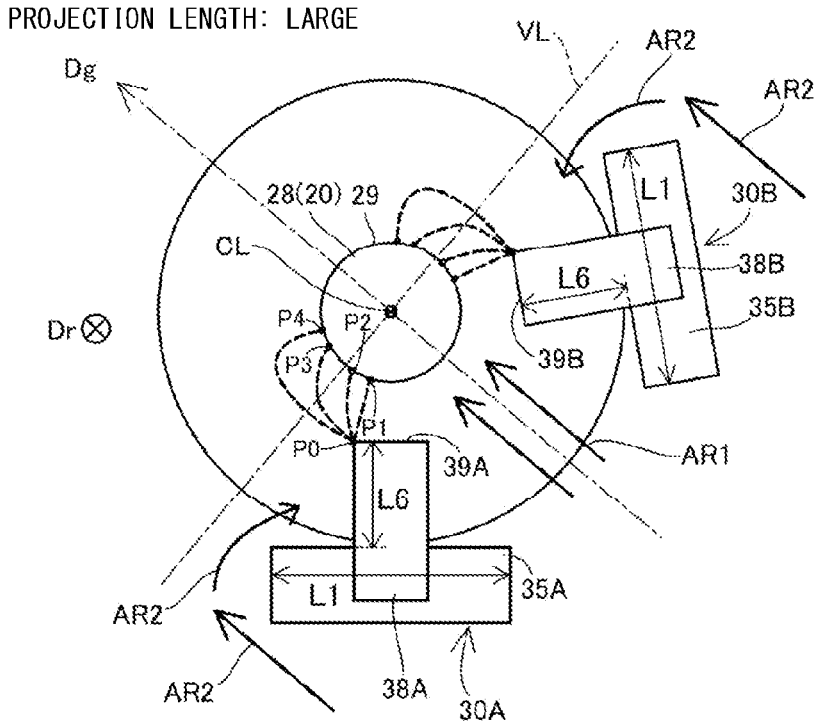
FIGS. 9(A) and 9(B) are views used for describing discharge in the spark plug 100 of the embodiment.
Figure 9B:
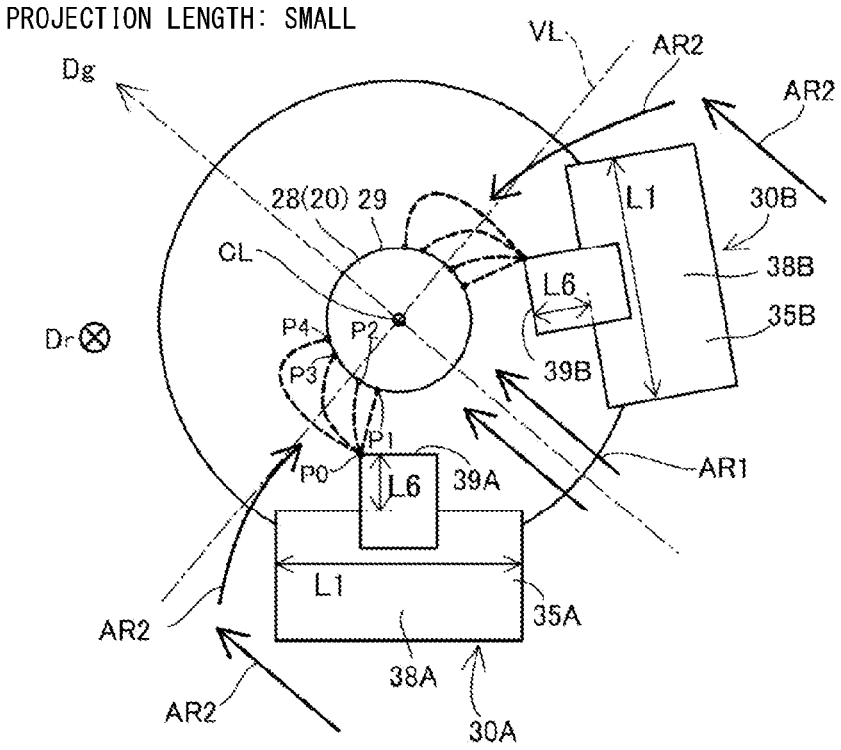

FIGS. 9(A) and 9(B) are views used for describing discharge in the spark plug 100 of the embodiment. As shown in FIG. 9(A), within the combustion chamber, in addition to the gas flow AR1 passing through the space between the two first ground electrodes 30A and 30B and reaching the vicinity of the gaps GA and GB, there are produced other gas flows AR2 which detour around the two first ground electrodes 30A and 30B and reach the vicinity of the gaps GA and GB. The direction of the gas flow AR1 becomes opposite the directions of the gas flows AR2 in the vicinity of the gaps GA and GB. As a result, if the influence of the gas flows AR2 becomes large, the flow of spark blown by the gas flow AR1 is hindered. As a result, conceivably, the speed of air-fuel mixture in the vicinity of the gaps GA and GB decreases, and expansion of a high temperature region does not occur smoothly, whereby ignition performance deteriorates.

The longer the length L1 of the ground electrode main body 35A and 35B, the greater the resistance the gas flows AR2 encounter to reach the vicinity of the gaps GA and GB, and the smaller the influence of the gas flows AR2. Therefore, in the case where the length L1 of the ground electrode main bodies 35A and 35B is equal to or greater than the outer diameter R1 (1.0 mm in the present experiment) of the center electrode, the influence of the gas flows AR2 is suppressed more as compared with the case where the length L1 is smaller than the outer diameter R1 of the center electrode. As a result, it is considered that a decrease in the speed of air-fuel mixture in the vicinity of the gaps GA and GB is suppressed, whereby extension of the spark discharge path caused by the flow of blown spark (FIG. 5) becomes more likely to occur. Accordingly, conceivably, expansion of a high temperature region occurs smoothly, and ignition performance improves. Similarly, in the case where the length L1 is greater than the outer diameter R1 of the center electrode, conceivably, extension of the spark discharge path caused by the flow of blown spark (FIG. 5) becomes more likely to occur as compared with the case where the length L1 is equal to the outer diameter R1 of the center electrode. Accordingly, conceivably, expansion of a high temperature region occurs smoothly, and ignition performance improves.

However, when the length L1 of the ground electrode main bodies 35A and 35B becomes excessively larger than the outer diameter R1 of the center electrode, the amount of the gas flow AR1 decreases. Therefore, when the length L1 of the ground electrode main bodies 35A and 35B becomes three times or more the outer diameter R1 of the center electrode as in the case of the sample S76, conceivably, the amount of the gas flow AR1 decreases and extension of the spark discharge path caused by the flow of blown spark (FIG. 5) becomes less likely to occur. Accordingly, it is considered that, when the length L1 becomes three times or more the outer diameter R1 of the center electrode, the ignition performance deteriorates.

As described above, it was found through the fourth evaluation test that the length L1 of the ground electrode main bodies 35A and 35B in the circumferential direction is preferably equal to or greater than the outer diameter R1 of the center electrode, and is more preferably greater than the outer diameter R1 of the center electrode. As a result, extension of the spark discharge path caused by the flow of blown spark (FIG. 5) can be promoted effectively by suppressing the influence of the gas flows AR2 detouring around the ground electrode main bodies 35A and 35B, whereby ignition performance can be further enhanced.

Also, it was found that, when the length L1 of the ground electrode main bodies 35A and 35B in the circumferential direction is rendered smaller than three times the outer diameter R1 of the center electrode, it becomes possible to suppress deterioration of ignition performance while securing the amount of the gas flow AR1.

Notably, as shown in Table 3, of the samples S73 through S75 in which the length L1 is greater than the outer diameter R1 of the center electrode, the sample S74 in which the length L1 is twice the outer diameter R1 of the center electrode is the largest in air-fuel ratio at the time of 1% misfire ratio, and is higher in ignition performance than the sample S73 in which the length L1 is 1.2 times the outer diameter R1 of the center electrode and the sample S75 in which the length L1 is 2.5 times the outer diameter R1 of the center electrode. Namely, it was found that the length L1 is preferably not smaller than the 1.2 times the outer diameter R1 of the center electrode but not greater than 2.5 times the outer diameter R1, and most preferably about twice the outer diameter R1 of the center electrode.

F. Fifth Evaluation Test

In the fifth evaluation test, an evaluation test was performed so as to determine a proper value of the projection length L6 (FIG. 4) of the ground electrode tips 38A and 38B. In the fifth evaluation test, there were used four types of samples S81 through S84 of the spark plug 100 (FIG. 4) of the present embodiment. The samples S81 through S84 differ from one another in terms of the projection length L6 of the ground electrode tips 38A and 38B; i.e., the projection lengths L6 of the ground electrode tips 38A and 38B of the samples S81 through S84 are 0.1 mm, 0.3 mm, 0.5 mm, and 0.7 mm, respectively.

Figure 10:
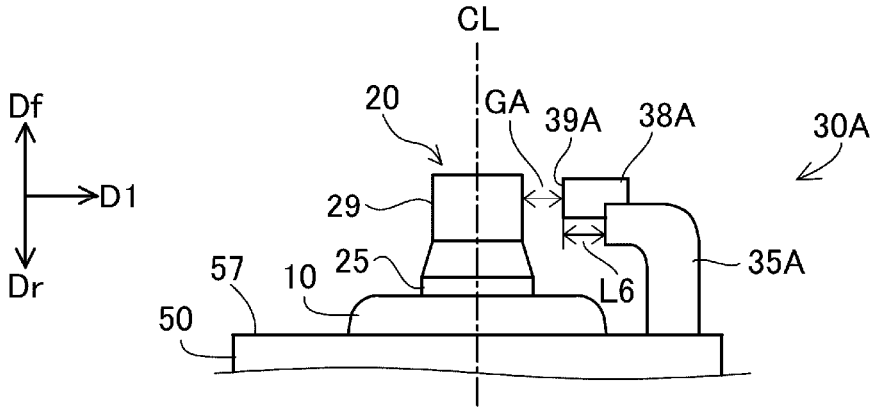
FIG. 10 is a view showing an example of a sample used in a fifth evaluation test.

FIG. 10 is a view showing an example of the samples used in the fifth evaluation test. As shown in FIG. 10, an adjustment for shortening the projection length L6 was performed by bending, into an L-like shape, an end of the ground electrode main body 35A (35B) located in the forward direction Df side. Namely, by causing the end of the ground electrode main body 35A (35B) on the forward direction Df side to protrude inward in the radial direction, the projection length L6 was adjusted without changing the length of the gap GA (GB).

Notably, the configurations of the four types of the samples S81 through S84 of the present embodiment, excluding the projection length L6 of the ground electrode tips 38A and 38B, are the same as that of the sample S74 used in the fourth evaluation test.

In the fifth evaluation test, a test identical with the second evaluation test and the fourth evaluation test was performed so as to determine the air-fuel ratio at the time of 1% misfire ratio for each sample. Table 5 shows the results of the fifth evaluation test.

TABLE 5

| Sample No. | Projection length L6 (mm) | Air-fuel ratio when misfire ratio was 1% |
|---|---|---|
| S81 | 0.1 | 23.2 |
| S82 | 0.3 | 24.3 |
| S83 | 0.5 | 25.1 |

It was found from Table 5 that the longer the projection length L6 of the ground electrode tips 38A and 38B, the greater the air-fuel ratio at the time of 1% misfire ratio, and the higher the ignition performance. Further, it was found that the air-fuel ratios at the time of 1% misfire ratio in the cases of the samples S83 and S84 in which the projection length L6 of the ground electrode tips 38A and 38B is equal to or greater than 0.5 mm are greater by 0.8 or more than those in the cases of the samples S81 and S82 in which the projection length L6 is less than 0.5 mm, and the ignition performances of the samples S83 and S84 are remarkably excellent. A large difference in the air-fuel ratios at the time of 1% misfire ratio was not observed between the sample S83 in which the projection length L6 is 0.5 mm and the sample S84 in which the projection length L6 is 0.7 mm.

The reason for this will be described. FIG. 9(A) shows an example of the spark plug 100 of the embodiment in which the projection length L6 is relatively large. FIG. 9(B) shows an example of the spark plug 100 of the embodiment in which the projection length L6 is relatively small. In the case where the projection length L6 is relatively large as shown in FIG. 9(A), the gas flows AR2 detouring around the ground electrode main bodies 35A and 35B are less likely to reach the vicinity of the gaps GA and GB. As a result, in the case where the projection length L6 is relatively large, the influence of the gas flows AR2 becomes relatively small, and a drop in ignition performance due to the influence of the gas flows AR2 can be suppressed. Meanwhile, in the case where the projection length L6 is relatively small as shown in FIG. 9(B), the gas flows AR2 detouring around the ground electrode main bodies 35A and 35B are more likely to reach the vicinity of the gaps GA and GB as compared with the case where the projection length L6 is relatively large. As a result, in the case where the projection length L6 is relatively small, the influence of the gas flows AR2 becomes large as compared with the case where the projection length L6 is relatively large, whereby a drop in ignition performance due to the influence of the gas flows AR2 becomes large.

As described above, it was found through the fifth evaluation test that the longer the projection length L6 of the ground electrode tips 38A and 38B, the greater the air-fuel ratio at the time of 1% misfire ratio and the higher the ignition performance. In particular, it was found that the projection length L6 of the ground electrode tips 38A and 38B is preferably equal to or greater than 0.5 mm Thus, it becomes possible to enhance ignition performance further by suppressing the influence of the gas flows AR2 detouring around the ground electrode main bodies 35A and 35B.

G. Sixth Evaluation Test

In the sixth evaluation test, the ignition performance of the spark plug 100 of the embodiment and the ignition performance of a spark plug for longitudinal discharge were compared while the condition of supply of current by an ignition apparatus (also referred to as a current supply apparatus) was changed. In the sixth evaluation test, the sample S83 used in the fifth evaluation test was used as a sample of the spark plug 100 of the embodiment. Also, the sample S21 used in the first evaluation test was used as a sample (FIG. 6(B)) of the spark plug for longitudinal discharge.

Figure 11:
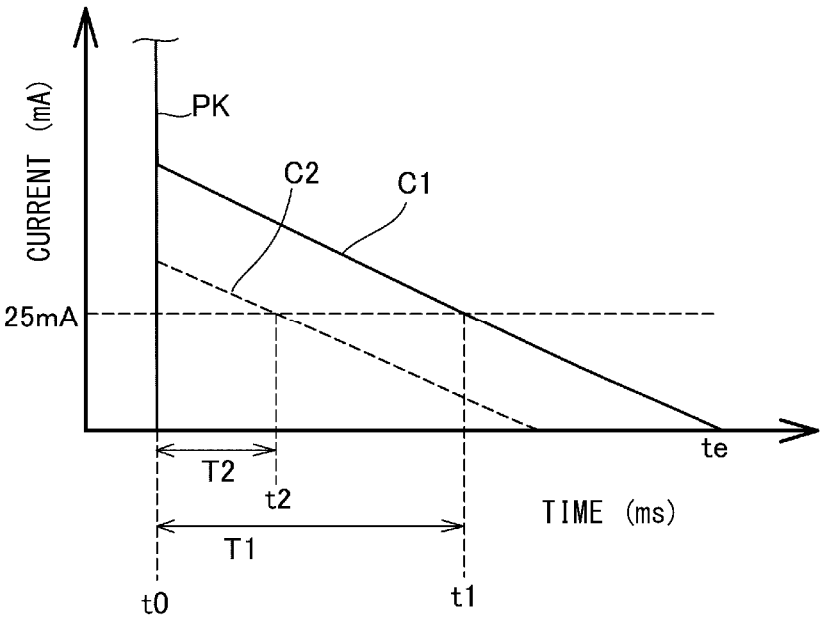
FIG. 11 is a graph used for describing an ignition apparatus used in a sixth evaluation test.

FIG. 11 is a graph used for describing an ignition apparatus used in the sixth evaluation test. The horizontal axis of the graph of FIG. 11 shows time (unit: ms (millisecond)), and the vertical axis thereof shows the current (unit: mA (milliampere)) supplied to the spark plug (sample). In FIG. 11, the time at which spark discharge was generated as a result of application of a high voltage to the spark plug by the ignition apparatus is represented by t0. The continuous line C1 of FIG. 11 shows a change in the current when the spark plug is driven by the ignition apparatus operated under a prescribed condition. As indicated by the continuous line C1, a peak PK of the current appears instantaneously within a very short period of time (for example, several tens μs) after the time t0 at which the spark discharge was generated; i.e., the occurrence of dielectric breakdown of the gap (FIG. 11). After that, as indicated by a slanted straight portion of the continuous line C1, the current decreases gradually over a time of 1 ms through several milliseconds and finally becomes zero. In the example indicated by the continuous line C1, the current becomes zero at time te. Such a continuous line C1 is observed when multiple discharge stemming from spark blowout does not occur.

In the example indicated by the continuous line C1, a point in time at which the current has decreased to 25 mA is represented by t1. A period of time T1 between the time point t0 and the time point t1 is a period of time during which the current supplied to the spark plug is equal to or greater than 25 mA. This period of time T1 is defined as a current duration. This current duration can be changed by changing the specifications of the ignition apparatus (for example, the specifications of a capacitor and a coil used therein) or conditions such as control (for example, switching control of a transistor). For example, the ignition apparatus can be operated such that the characteristic indicated by the continuous line C1 is obtained, or operated such that the characteristic indicated by the dashed line C2 is obtained. In the example of FIG. 11, when the characteristic indicated by the continuous line C1 is selected, the current duration is the time T1 from the time point t0 to the time point t1 as described above, and when the characteristic indicated by the dashed line C2 is selected, the current duration is a time T2 from the time point t0 to a time point t2. The longer the current duration, the larger the energy supplied to the spark plug from the ignition apparatus.

In the sixth evaluation test, there was used five types of ignition apparatuses whose current durations in the case where spark blowout does not occur are 0.1 ms, 0.3 ms, 0.5 ms, 0.7 ms, and 1 ms, respectively. Notably, the current supply capacity of the ignition apparatus used in the first through fifth evaluation tests is approximately equal to that of the ignition apparatus which was used in the sixth evaluation test and whose current duration is 0.3 ms.

In the sixth evaluation test, each of the above-described two types of samples S83 and S21 was driven through use of the six types of ignition apparatuses, a test identical with the test performed in the second, fourth, and fifth evaluation tests was performed, and the air-fuel ratio at the time of 1% misfire ratio was determined for a combination of each sample and each ignition apparatus. In the present evaluation test, the air-fuel ratio at the time of 1% misfire ratio of each sample determined through use of the ignition apparatus whose current duration is 0.1 ms was used as a reference value of the air-fuel ratio of each sample. Differences between the reference value and air-fuel ratios at the time of 1% misfire ratio determined through use of the four types of ignition apparatuses whose current duration are 0.3 ms, 0.5 ms, 0.7 ms, and 1 ms, respectively, were calculated as evaluation values. Notably, the air-fuel ratio at the time of 1% misfire ratio of the sample S21 determined through use of the ignition apparatus whose current duration is 0.1 ms; i.e., the reference value of the sample S21, was 22. Also, the air-fuel ratio at the time of 1% misfire ratio of the sample S83 determined through use of the ignition apparatus whose current duration is 0.1 ms; i.e., the reference value of the sample S83, was 25. FIG. 6 shows the results of the sixth evaluation tests.

TABLE 6

Differences of air-fuel ratios at the time of 1% misfire ratio from the reference values

| | Current Duration (ms) | | | | |
|---|---|---|---|---|---|
| Sample Number | 0.1 | 0.3 | 0.5 | 0.7 | 1 |
| S21 | 0 | 0.3 | 0.3 | 0.3 | 0.3 |
| S83 | 0 | 0.3 | 0.7 | 0.9 | 1 |

As can be understood from Table 6, in the case of the sample S21 of the spark plug for longitudinal discharge, when the ignition apparatus whose current duration is 0.3 ms was used, an increase in the air-fuel ratio at the time of 1% misfire ratio was observed as compared with the case where the ignition apparatus whose current duration is 0.1 ms was used. However, in the case of the sample S21, when the ignition apparatuses whose current duration are 0.5 ms, 0.7 ms, and 1 ms were used, no increase in the air-fuel ratio at the time of 1% misfire ratio was observed as compared with the case where the ignition apparatus whose current duration is 0.3 ms was used. Namely, enhancement of the ignition performance of the sample S21 was not observed even when an ignition apparatus having a relatively high energy supply capacity, such as an ignition apparatus whose current duration is 0.5 ms or longer, was used.

In the case of the spark plug for longitudinal discharge, even when an ignition apparatus whose current duration is 0.5 ms or longer is used, spark blowout occurs. Therefore, in actuality, current cannot be supplied to the spark plug over a long period of time. Accordingly, it is considered that, even when an ignition apparatus having a high energy supply capacity, such as an ignition apparatus whose current duration is 0.5 ms or longer, is used, the energy release amount of spark discharge of the spark plug for longitudinal discharge does not increase.

Meanwhile, in the case of the sample S83 of the spark plug 100 of the present embodiment, within the range of current duration of 0.1 ms to 1 ms, the air-fuel ratio at the time of 1% misfire ratio increases with the current duration of the ignition apparatus used. Namely, in the case of the sample S83, the longer the current duration (higher the energy supply capacity) of the ignition apparatus used, the greater the degree to which the ignition performance is enhanced. Namely, it was found that, unlike the sample S21 of the spark plug for longitudinal discharge, the ignition performance of the sample S83 of the spark plug 100 of the present embodiment improves in accordance with the energy supply capacity of an ignition apparatus used to drive the spark plug, even when the current duration of the ignition apparatus is 0.5 ms or longer.

As described above, in the spark plug 100 of the present embodiment, spark blowout is less likely to occur as compared with the spark plug for longitudinal discharge. Therefore, current can be supplied from the ignition apparatus to the spark plug 100 for a long period of time. Accordingly, the energy release amount of spark discharge of the spark plug 100 increases with the current duration of the ignition apparatus used. As a result, it is considered that the longer the current duration of the ignition apparatus used, the greater the degree to which the ignition performance of the spark plug 100 is enhanced.

As described above, the following was found through the sixth evaluation test. In the case where the spark plug 100 of the present embodiment is driven by an ignition apparatus which can supply current for a relatively long time, specifically, can supply a current of 25 mA or more for 0.5 ms or longer, the spark plug 100 can realize an ignition performance corresponding to the current supply capacity (electrical energy supply capacity) of the ignition apparatus.

H. Modifications (1) The structure of the ground electrodes 30A and 30B is not limited to the above-described structure, and other structures may be employed. In the above-described embodiment, the ground electrode main bodies 35A and 35B are formed separately from the metallic shell 50 and welded to the metallic shell 50. Alternatively, a single member having the metallic shell 50 and the ground electrode main bodies 35A and 35B may be formed from a single metallic material through cutting. Also, each of the ground electrode main bodies 35A and 35B may have a double layer structure including a core formed of copper or the like.

Also, in the above-described embodiment, the entire surfaces of the ground electrode tips 38A and 38B on the inner side in the radial direction face the side surface 29 of the electrode tip 28. Namely, the entire surfaces of the ground electrode tips 38A and 38B on the inner side in the radial direction serve as the discharge surfaces 39A and 39B. Alternatively, portions of the surfaces of the ground electrode tips 38A and 38B on the inner side in the radial direction may face the side surface 29 of the electrode tip 28. Namely, it is sufficient that the axial position of at least a portion of the side surface 29 of the electrode tip 28 is the same as that of at least portions of the surfaces of the ground electrode tips 38A and 38B on the inner side in the radial direction.

Also, each of the ground electrode is composed of two members; i.e., a ground electrode main body and a ground electrode tip. However, each ground electrode may be constituted by a single member formed of nickel, a nickel alloy, or a tungsten alloy.

(2) The structure of the spark plug 100 is not limited to the above-described structure, and other various structures may be employed. For example, the center electrode 20 is not required to be composed of two members; i.e., the center electrode tip 28 and the shaft portion 27, and may be constituted by a single member.

(3) As described above, it is considered that enhancement of the ignition performance and durability of the spark plug 100 of the above-described embodiment is achieved by the ground electrodes 30A and 30B and the center electrode 20. Therefore, the configurations of other structural elements, such as the material and dimensions of various parts of the metallic shell 50 and the material and dimensions of various parts of the insulator 10, may be changed freely. For example, the material of the metallic shell 50 may be low-carbon steel plated with zinc or nickel, or un-plated carbon steel. Also, the material of the insulator 10 may be any of various insulating ceramics other than alumina.

(4) The structure of the internal combustion engine 700 is not limited to the above-described structure, and other various structures can be employed. For example, the total number of the intake valves 730 of each combustion chamber 790 may be one, three, or more. Also, the total number of the exhaust valves 740 of each combustion chamber 790 may be one, three, or more Although the present invention has been described on the basis of embodiments and modifications thereof, the embodiments of the present invention are provided for facilitating an understanding of the present invention and do not limit the scope of the present invention. The present invention may be changed and improved without departing from the scope of the present invention, and encompasses equivalents thereof.

DESCRIPTION OF REFERENCE NUMERALS

5 . . . gasket
6 . . . first rear-end-side packing
7 . . . second rear-end-side packing
8 . . . forward-end-side packing
9 . . . talc
10 . . . insulator
11 . . . second outer-diameter decreasing portion
12 . . . axial hole
13 . . . leg portion
15 . . . first outer-diameter decreasing portion
16 . . . inner-diameter decreasing portion
17 . . . forward-end-side trunk portion
18 . . . rear-end-side trunk portion
19 . . . flange portion
20 . . . center electrode
21 . . . outer layer
22 . . . core
23 . . . head portion
24 . . . flange portion
25 . . . leg portion
27 . . . shaft portion
28 . . . center electrode tip
29 . . . discharge side surface
30A . . . first ground electrode
30B . . . second ground electrode
35A . . . first ground electrode main body
35B . . . second ground electrode main body
38A . . . first ground electrode tip
38B . . . second ground electrode tip
40 . . . metallic terminal
50 . . . metallic shell
51 . . . tool engagement portion
52 . . . screw portion
53 . . . crimp portion
54 . . . seat portion
55 . . . trunk portion
56 . . . inner-diameter decreasing portion
57 . . . forward end surface
58 . . . deformable portion
59 . . . through hole
60 . . . first seal portion
70 . . . resistor
80 . . . second seal portion
100 . . . spark plug
700 . . . internal combustion engine
710 . . . engine head
711 . . . first wall
712 . . . intake port
713 . . . second wall
714 . . . exhaust port
718 . . . attachment hole
719 . . . inner wall
720 . . . cylinder block
729 . . . cylinder wall
730*a* . . . first intake valve
740*a* . . . exhaust valve
750 . . . piston
790 . . . combustion chamber Having described the invention, the following is claimed:

1. A spark plug comprising:

a center electrode extending in a direction of an axial line;

an insulator having an axial hole which extends in the direction of the axial line and in which the center electrode is disposed; and a metallic shell disposed around the insulator, wherein the metallic shell has a first ground electrode which is electrically connected to the metallic shell and has a first surface facing a side surface of the center electrode in a radial direction so as to form a first gap, and a second ground electrode which is electrically connected to the metallic shell and has a second surface facing the side surface of the center electrode in the radial direction so as to form a second gap;

a relation $60° \leq \theta \leq 150°$ is satisfied, where $\theta$ is a smaller one of angles formed between a first line connecting the axis and a center of the first surface and a second line connecting the axial line and a center of the second surface when viewed from a forward end side toward a rear end side in the direction of the axis; and the metallic shell has a specific plane which bisects the metallic shell such that all the ground electrodes are located on one side of the plane, wherein at a position in the direction of the axis at which the first surface and the second surface face each other, the center electrode has an outer diameter greater than largest widths of the first surface and the second surface.

2. A spark plug according to claim 1, wherein the first ground electrode has a first ground electrode tip including the first surface, and a first ground electrode main body to which the first ground electrode tip is joined;

the second ground electrode has a second ground electrode tip including the second surface, and a second ground electrode main body to which the second ground electrode tip is joined; and largest widths of the first ground electrode main body and the second ground electrode main body are greater than the outer diameter of the center electrode.

3. A spark plug according to claim 1, wherein the first ground electrode has a first ground electrode tip including the first surface, and a first ground electrode main body to which the first ground electrode tip is joined;

the second ground electrode has a second ground electrode tip including the second surface, and a second ground electrode main body to which the second ground electrode tip is joined; and a projection length by which the first ground electrode tip projects from the first ground electrode main body inward in the radial direction of the metallic shell and a projection length by which the second ground electrode tip projects from the second ground electrode main body inward in the radial direction of the metallic shell are equal to or greater than 0.5 mm.

4. A spark plug according to claim 1, wherein the spark plug is driven by a current supply section which can supply a current of 25 mA or more to the spark plug over a period of 0.5 ms or longer for discharge of one time.

5. A spark plug according to claim 1, wherein the spark plug is attached to an internal combustion engine in such a manner that when viewed from the forward end side toward the rear end side in the direction of the axial line, an upstream portion of a flow path of an air-fuel mixture passing through the first gap and the second gap within a combustion chamber of the internal combustion engine is located within a range of the angle θ.

6. A spark plug according to claim 2, wherein the first ground electrode has a first ground electrode tip including the first surface, and a first ground electrode main body to which the first ground electrode tip is joined;

the second ground electrode has a second ground electrode tip including the second surface, and a second ground electrode main body to which the second ground electrode tip is joined; and a projection length by which the first ground electrode tip projects from the first ground electrode main body inward in the radial direction of the metallic shell and a projection length by which the second ground electrode tip projects from the second ground electrode main body inward in the radial direction of the metallic shell are equal to or greater than 0.5 mm.

7. A spark plug according to claim 2, wherein the spark plug is driven by a current supply section which can supply a current of 25 mA or more to the spark plug over a period of 0.5 ms or longer for discharge of one time.

8. A spark plug according to claim 3, wherein the spark plug is driven by a current supply section which can supply a current of 25 mA or more to the spark plug over a period of 0.5 ms or longer for discharge of one time.

9. A spark plug according to claim 2, wherein the spark plug is attached to an internal combustion engine in such a manner that when viewed from the forward end side toward the rear end side in the direction of the axial line, an upstream portion of a flow path of an air-fuel mixture passing through the first gap and the second gap within a combustion chamber of the internal combustion engine is located within a range of the angle θ.

10. A spark plug according to claim 3, wherein the spark plug is attached to an internal combustion engine in such a manner that when viewed from the forward end side toward the rear end side in the direction of the axial line, an upstream portion of a flow path of an air-fuel mixture passing through the first gap and the second gap within a combustion chamber of the internal combustion engine is located within a range of the angle θ.

11. A spark plug according to claim 4 wherein the spark plug is attached to an internal combustion engine in such a manner that when viewed from the forward end side toward the rear end side in the direction of the axial line, an upstream portion of a flow path of an air-fuel mixture passing through the first gap and the second gap within a combustion chamber of the internal combustion engine is located within a range of the angle θ.

* * * * *